US008981633B2

(12) United States Patent
Sakakura et al.

(10) Patent No.: US 8,981,633 B2
(45) Date of Patent: Mar. 17, 2015

(54) SPARK PLUG AND PRODUCTION METHOD THEREFOR

(75) Inventors: Yasushi Sakakura, Ichinomiya (JP); Yuichi Matsunaga, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/007,691

(22) PCT Filed: Mar. 7, 2012

(86) PCT No.: PCT/JP2012/001564

§ 371 (c)(1),
(2), (4) Date: Sep. 26, 2013

(87) PCT Pub. No.: WO2012/147262

PCT Pub. Date: Nov. 1, 2012

(65) Prior Publication Data

US 2014/0015398 A1 Jan. 16, 2014

(30) Foreign Application Priority Data

Apr. 25, 2011 (JP) ..... 2011-096767

(51) Int. Cl.
*H01T 13/20* (2006.01)
*H01T 21/02* (2006.01)
(Continued)

(52) U.S. Cl.
CPC ..... *H01T 13/32* (2013.01); *H01T 21/02* (2013.01); *H01T 13/467* (2013.01); *H01T 13/20* (2013.01); *F02P 13/00* (2013.01)
USPC ..... 313/140; 313/118; 313/141; 445/7

(58) Field of Classification Search
CPC ..... H01T 13/20; H01T 13/32; H01T 13/467; H01T 21/02; F02P 13/00
USPC ..... 123/169 R, 169 EL, 32, 41, 310; 313/118–145; 445/7
See application file for complete search history.

(56) References Cited

U.S. PATENT DOCUMENTS 3,870,918 A * 3/1975 Senda et al. ..... 313/131 R
5,693,999 A 12/1997 Osamura et al. ..... 313/141
(Continued)

FOREIGN PATENT DOCUMENTS

CN 101223680 A 7/2008 ..... H01T 13/20
CN 201204382 Y 3/2009 ..... H01T 13/22
(Continued)

OTHER PUBLICATIONS

International Search Report for International Application No. PCT/JP2012/001564, Jun. 12, 2012.
(Continued)

*Primary Examiner* — Nimeshkumar Patel
*Assistant Examiner* — Jose M Diaz
(74) *Attorney, Agent, or Firm* — Kusner & Jaffe

(57) ABSTRACT

A technique of reducing occurrence of multiple discharge in a spark plug. The spark plug has a main ground electrode and three auxiliary ground electrodes. The position at which first auxiliary ground electrode is joined to a metallic shell is located opposite the position at which main ground electrode is joined to the metallic shell, with respect to a center electrode. The positions at which second and third auxiliary ground electrodes are joined to the metallic shell are located opposite to each other with respect to the center electrode. When the width of first auxiliary ground electrode is represented by W, the shortest distance between second auxiliary ground electrode and third auxiliary ground electrode is represented by T, and a distance which is a component of the shortest distance T in a direction orthogonal to first auxiliary ground electrode is represented by Tp, a relation W≥Tp is satisfied.

10 Claims, 13 Drawing Sheets

(51) Int. Cl.

| | |
|---|---|
| ***H01T 13/46*** | (2006.01) |
| ***H01T 13/32*** | (2006.01) |
| *F02P 13/00* | (2006.01) |

(56) References Cited

U.S. PATENT DOCUMENTS

| | | | | |
|---|---|---|---|---|
| 5,929,556 | A * | 7/1999 | Matsubara et al. | 313/141 |
| 6,407,487 | B1 * | 6/2002 | Sugimoto | 313/141 |
| 8,203,258 | B2 * | 6/2012 | Kameda et al. | 313/141 |
| 2003/0085643 | A1 | 5/2003 | Matsubara | 313/141 |
| 2008/0164800 | A1 | 7/2008 | Watanabe | 313/141 |
| 2009/0026910 | A1 | 1/2009 | Tanaka et al. | 313/141 |
| 2010/0320894 | A1 * | 12/2010 | Hartmann et al. | 313/142 |
| 2011/0215702 | A1 * | 9/2011 | Kameda et al. | 313/141 |

FOREIGN PATENT DOCUMENTS

| | | | | |
|---|---|---|---|---|
| JP | 51-95541 | | 2/1975 | H01T 13/46 |
| JP | 60-81784 | | 5/1985 | H01T 13/46 |
| JP | H 0311575 | A | 1/1991 | H01T 21/02 |
| JP | 05-326107 | | 12/1993 | H01T 13/32 |
| JP | H08 222350 | | 8/1996 | H01T 13/20 |
| JP | 8-315955 | | 11/1996 | H01T 13/32 |
| JP | 2001-237045 | | 8/2001 | H01T 13/32 |
| JP | 2005-183189 | | 7/2005 | H01T 13/32 |
| JP | 2006-318696 | | 11/2006 | H01T 13/32 |
| JP | 2008-171646 | | 7/2008 | H01T 13/20 |
| WO | WO 2007/010867 | | 1/2007 | H01T 13/54 |

OTHER PUBLICATIONS

Supplementary European Search Report issued in connection with corresponding European Patent Application No. 12777255.6, Sep. 18, 2014.

Office Action issued in corresponding Chinese Patent Application No. 201280019782.2, issued Oct. 20, 2014 (English-language translation provided).

* cited by examiner (A)

(B)

(A)

(B)

MULTIPLE DISCHARGE GENERATION RATIO OF EACH SAMPLE Xave (%)

| SAMPLE | | S01 | S02 | S03 | S04 | S05 |
|---|---|---|---|---|---|---|
| SHAPE | Appearance | FIG. 2 (except S) | FIG. 2 | FIG. 6(B) | FIG. 7 | FIG. 8 |
| | Auxiliary electrode width W (mm) | 2.7 | 2.7 | 2.7 | 2.2 | 2.2 |
| | Inter auxiliary electrode distance T (mm) | 2.4 | 2.4 | 2.4 | 3.5 | 3.5 |
| | Auxiliary electrode offset S (mm) | 0.8 | 0.7 | -0.1 | 0.8 | 0.7 |
| | Parametric relations | $T \leq W$ $0.7 < S$ | $T \leq W$ $S \leq 0.7$ | $T \leq W$ $S < 0$ | $W < T$ $0.7 < S$ | $W < T$ $S \leq 0.7$ |
| Xave (%) | Gas flow direction: front | 35 | 35 | 35 | 50 | 50 |
| | Gas flow direction: lateral | 45 | 40 | 35 | 50 | 45 |

FIG. 13

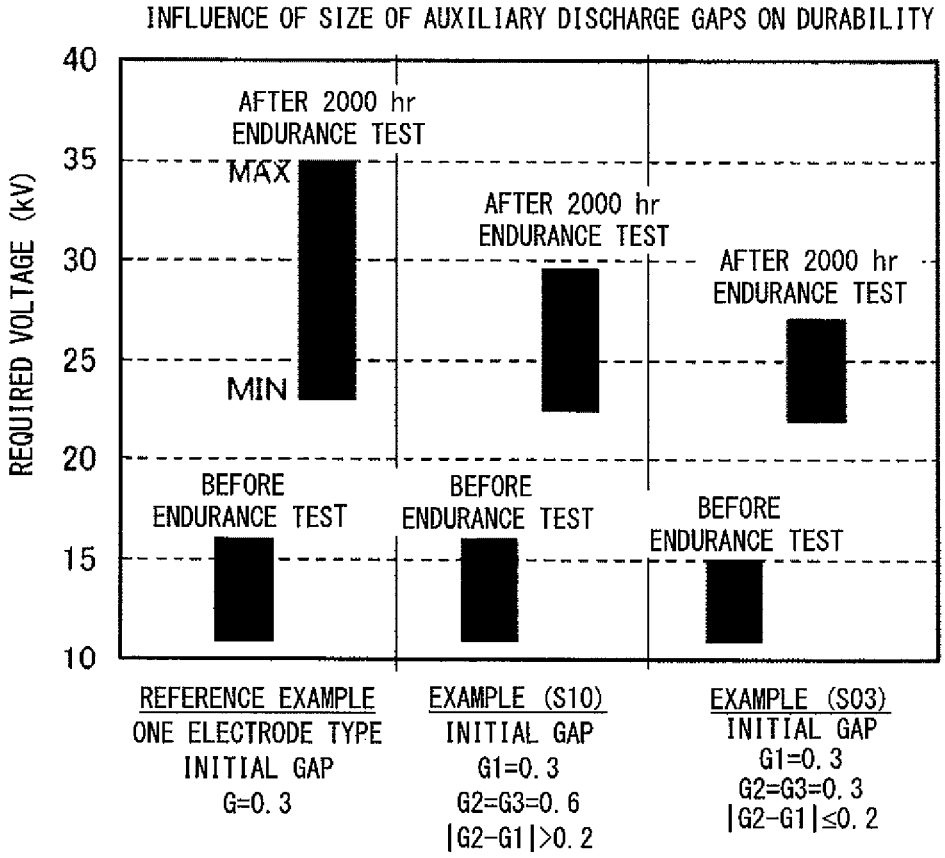

FIG. 14

SPARK PLUG AND PRODUCTION METHOD THEREFOR

FIELD OF THE INVENTION

The present invention relates to a spark plug and to a production method therefor.

BACKGROUND OF THE INVENTION

As is well known, a spark plug generates spark discharge for ignition at a discharge gap between a center electrode and a ground electrode. The shapes of the center electrode and the ground electrode have been adaptively changed in various ways in accordance with the intended use and required properties of the spark plug. In particular, there has been known a spark plug in which a plurality of ground electrodes are provided so as to realize improvement of fouling resistance and ignition performance, lowering of a voltage required for discharge (required voltage), etc. For example, see Japanese Patent Application Laid-Open (kokai) No. S60-081784 ("Patent Document 1"); Japanese Patent Application Laid-Open (kokai) No. H05-326107 ("Patent Document 2"); Japanese Patent Application Laid-Open (kokai) No. H08-315955 ("Patent Document 3"); Japanese Patent Application Laid-Open (kokai) No. 2001-237045 ("Patent Document 4"); Japanese Patent Application Laid-Open (kokai) No. 2005-183189 ("Patent Document 5"); and Japanese Patent Application Laid-Open (kokai) No. 2008-171646 ("Patent Document 6").

A spark plug having a plurality of ground electrodes has a problem in that if the shape and positions of the ground electrodes are improper, spark is deflected by a flow of gas around the discharge gap, and so-called multiple discharge occurs, or generation of multiple discharge cannot be restrained. If multiple discharge occurs, consumption of the electrodes is accelerated, whereby the service life of the spark plug becomes shorter.

An object of the present invention is to provide a technique for reducing the occurrence of multiple discharge in a spark plug.

SUMMARY OF THE INVENTION

The present invention has been conceived to solve, at least partially, the above problem and can be embodied in the following modes or application examples.

Application Example 1

A spark plug comprising:

a center electrode extending in an axial direction;

an insulator having an axial bore which extends in the axial direction and into which the center electrode is inserted;

a metallic shell disposed around the insulator;

a main ground electrode whose proximal end portion is joined to a forward end portion of the metallic shell and whose distal end portion forms a gap G1 in the axial direction in cooperation with a forward end portion of the center electrode; and three auxiliary ground electrodes whose proximal end portions are joined to the forward end portion of the metallic shell and whose distal end portions form gaps in cooperation with a side surface of the center electrode, wherein facing surfaces of the distal end portions of the three auxiliary ground electrodes which form the gaps in cooperation with the center electrode are located forward of the forward end of the insulator with respect to the axial direction;

a first auxiliary ground electrode of the three auxiliary ground electrodes is joined to the metallic shell at a position opposite a position at which the main ground electrode is joined to the metallic shell, with respect to the center electrode; and second and third auxiliary ground electrodes of the three auxiliary ground electrodes are joined to the metallic shell at positions opposite to each other with respect to the center electrode, the spark plug being characterized in that, when a width of the first auxiliary ground electrode is represented by W, a shortest distance between the second auxiliary ground electrode and the third auxiliary ground electrode is represented by T, and a distance which is a component of the shortest distance T in a direction orthogonal to the first auxiliary ground electrode is represented by Tp, a relation $W \geq Tp$ is satisfied.

Application Example 2

A spark plug according to Application example 1, wherein distances S2, S3 between the distal end portion of the first auxiliary ground electrode located on the side toward the center electrode and side surfaces of the distal end portions of the second and third auxiliary ground electrodes satisfy relations $S2 \geq 0.7$ mm and $S3 \leq 0.7$ mm.

Application Example 3

A spark plug according to Application example 2, wherein the gap G1 and the gaps G2, G3 between the center electrode and the second and third auxiliary ground electrodes satisfy relations $|G2-G1| \leq 0.2$ mm and $|G3-G1| \leq 0.2$ mm.

Application Example 4

A spark plug according to Application example 3, wherein the gap G1 satisfies a relation $0.2\text{ mm} \leq G1 \leq 1.0$ mm.

Application Example 5

A spark plug according to any one of Application examples 1 to 4, wherein a width L of the main ground electrode and the distance Tp satisfies a relation $L \geq Tp$.

Application Example 6

A spark plug according to Application example 5, wherein a relation $L \geq W \geq Tp$ is satisfied.

Application Example 7

A spark plug according to any one of Application examples 1 to 6, which is used for a gas engine.

Application Example 8

A method of producing a spark plug according to any one of Application examples 1 to 7, comprising:

a step of joining the first through third auxiliary ground electrodes to the metallic shell;

a step of bending the first through third auxiliary ground electrodes after the joining step; and an assembly step of assembling, after the bending step, the insulator and the center electrode into the metallic shell so as to form an assembly, the method being characterized by comprising:

a punching step of punching the distal end portions of the second and third auxiliary ground electrodes by using a punching tool having an approximately circular cross section such that a hollow space is formed at least a central portion between the distal end portions of the second and third auxiliary ground electrodes, wherein when a width of each of the second and third auxiliary ground electrodes measured along a direction which is orthogonal to a direction connecting the second and third auxiliary ground electrodes and is also orthogonal to the axial direction is represented by V and a diameter of the hollow space formed between the second and third auxiliary ground electrodes is represented by D, a relation $W^2 \geq D^2 - V^2$ is satisfied.

Application Example 9

A spark plug production method according to Application example 8, wherein lengths of the first through third auxiliary ground electrodes before being subjected to the bending are determined such that when the first through third auxiliary ground electrodes are bent simultaneously, a shortest distance M between a side surface of each of the second and third auxiliary ground electrodes on the side toward the first auxiliary ground electrode and the distal end of the first auxiliary ground electrode located on the side toward the second and third auxiliary ground electrodes satisfies a relation $M \geq 0$.

Application Example 10

A spark plug production method according to Application example 9, wherein the first through third auxiliary ground electrodes before being subjected to the bending have taper portions provided on the distal end portions thereof; and when the first through third auxiliary ground electrodes are bent simultaneously, the distal end of the first auxiliary ground electrode located on the side toward the second and third auxiliary ground electrodes is located on the center electrode side in relation to the side surfaces of the second and third auxiliary ground electrodes on the side toward the first auxiliary ground electrode.

Notably, the present invention can be implemented in various forms. For example, the present invention can be implemented as a spark plug, a metallic member for a spark plug, a production method therefor, or the like.

Effects of the Invention

According to the configuration of Application example 1, in addition to the main ground electrode, three auxiliary ground electrodes are provided, and a first auxiliary ground electrode of these auxiliary ground electrodes is provided at a position which is located opposite the main ground electrode with respect to the center electrode. Therefore, a gas flow from this direction can be blocked, whereby multiple discharge which occurs due to a gas flow in the vicinity of the discharge gap can be reduced. Notably, when the shortest distance between the second and third auxiliary ground electrodes is represented by T, the distance Tp which is a component of the shortest distance T in a direction orthogonal to the first auxiliary ground electrode can be considered to be an index which represents the size of a flow channel of gas which flows from the outside into the discharge gap along a direction in which the first auxiliary ground electrode extends. Accordingly, by configuring the spark plug such that the distance Tp and the width W of the first auxiliary ground electrode satisfy a relation $W \geq Tp$, a gas flow along the extension direction of the first auxiliary ground electrode can be blocked effectively, whereby multiple discharge which occurs due to such a gas flow can be reduced sufficiently.

In the spark plug of Application example 2, the distances S2, S3 can be considered as an index which represents the size of flow channels of gas which flows into the vicinity of the discharge gap along the side surfaces of the distal end portions of the second and third auxiliary ground electrodes. Accordingly, by setting these distances S2, S3 to 0.7 mm or smaller, the effect of blocking a gas flow along this direction can be enhanced, whereby multiple discharge which occurs due to such a gas flow can be reduced further.

According to the configuration of Application example 3, the difference between the size of the gap G1 between the center electrode and the main ground electrode, and the size of the gaps G2, G3 between the center electrode and the second and third auxiliary ground electrodes is sufficiently small. Therefore, each of the gaps G1, G2, G3 can be used as a discharge gap. As a result, the voltage required to start discharge can be reduced.

According to the configuration of Application example 4, the size of the discharge gap G1 between the center electrode and the main ground electrode is small, and multiple discharge tends to easily occur due to a gas flow in the vicinity of the discharge gap. Therefore, the above-described effect of reducing the multiple discharge by blocking the gas flow is remarkable.

According to the configuration of Application example 5, the width L of the main ground electrode is set such that it becomes equal to or greater the distance Tp (representing the size of the flow channel of gas which flows into the discharge gap). Therefore, the gas which flows into the discharge gap from the side of the main ground electrode can be blocked efficiently, whereby multiple discharge can be reduced further.

According to the configuration of Application example 6, the gas which flows into the discharge gap from the side of the main ground electrode and the gas which flows into the discharge gap from the side of the first auxiliary ground electrode can be blocked efficiently, whereby multiple discharge can be reduced to a sufficient degree.

In the spark plug of Application example 7; i.e., a spark plug for a gas engine, multiple discharge tends to easily occur due to a gas flow in the vicinity of the discharge gap as compared with a spark plug for a gasoline engine or an alcohol engine. Accordingly, in the spark plug for a gas engine, the effect of reducing the multiple discharge by blocking the gas flow is remarkable.

According to the configuration of Application example 8, a hollow space is formed centrally between the distal end portions of the second and third auxiliary ground electrodes through use of a punching tool. Therefore, a hollow space can be readily formed such that small gaps are formed between the center electrode and the second and third auxiliary ground electrodes. A parameter $(D^2 - V^2)$ can be considered as an index which represents the size of a flow channel of gas which flows into the hollow space from the space between the second and third auxiliary ground electrodes. Meanwhile, a parameter W represents the width of the first auxiliary ground electrode. Accordingly, by forming the hollow space such that a relation $W^2 \geq D^2 - V^2$ is satisfied, such a gas flow can be effectively blocked by the first auxiliary ground electrode, whereby multiple discharge can be reduced.

According to the configuration of Application example 9, it is possible to prevent the first through third auxiliary ground electrodes from interfering with one another during bending.

According to the configuration of Application example 10, the distal ends of the first through third auxiliary ground electrodes can be made closer to one another. Therefore, the hollow space which is subsequently formed by punching the distal ends can be made smaller. As a result, the gas flow into the hollow space can be blocked effectively, whereby multiple discharge can be reduced.

BRIEF DESCRIPTION OF THE DRAWINGS

FIG. 13 is a table showing the shapes of spark plug samples S01 to S05 and their experimental results.

FIG. 14 is an illustration showing results of a test performed for determining the influence of the sizes of auxiliary discharge gaps on the durability of spark plugs.

DETAILED DESCRIPTION OF THE INVENTION

Figure 1:
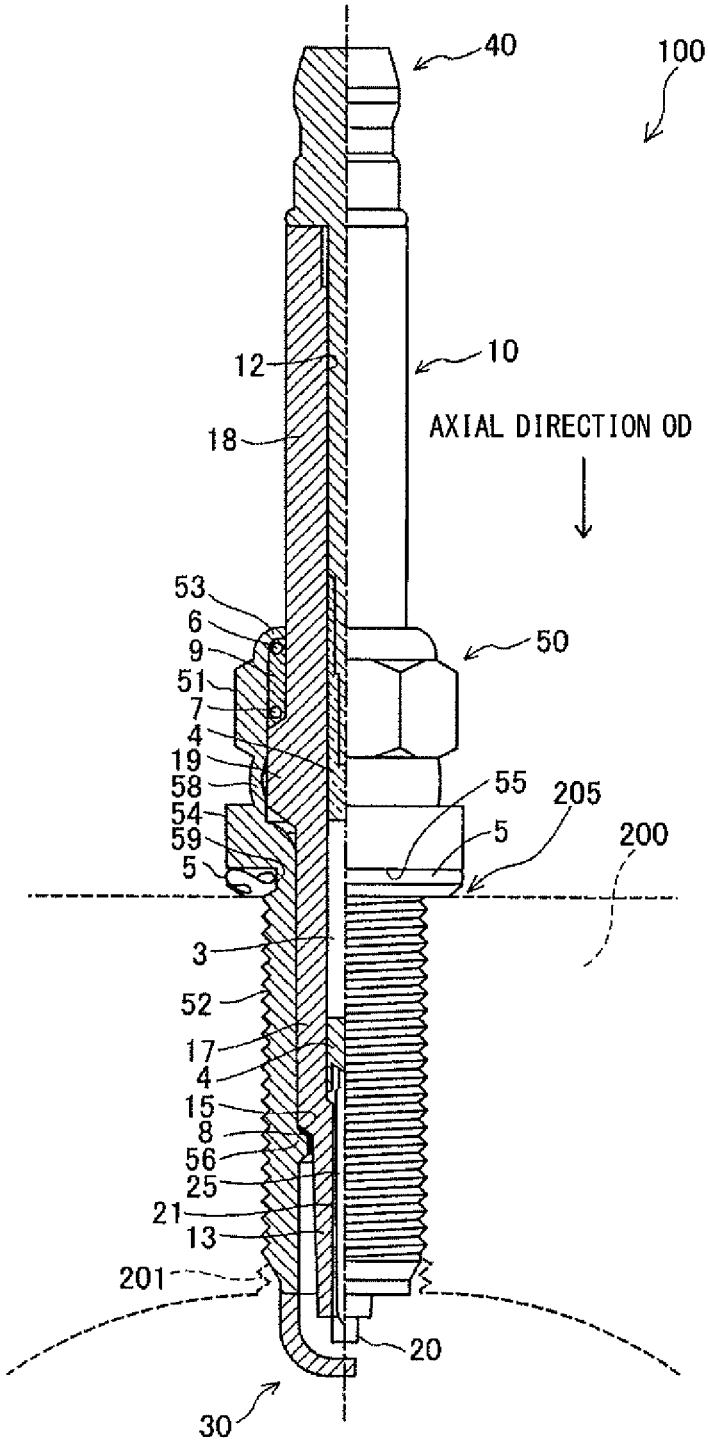
FIG. 1 is a partially sectional view of a spark plug according to one embodiment of the present invention.

FIG. 1 is a partially sectional view of a spark plug 100 according to one embodiment of the present invention. In the following description, the axial direction OD of the spark plug 100 in FIG. 1 is referred to as the vertical direction in the drawings; the lower side is referred to as the forward side of the spark plug 100; and the upper side as the rear side. The spark plug 100 includes a ceramic insulator 10 which serves as an insulator; a metallic shell 50 which holds the ceramic insulator 10; a center electrode 20 which is held within the ceramic insulator 10 such that the center electrode 20 extends in the axial direction OD; a ground electrode 30; and a metal terminal 40 which is provided at the rear end of the ceramic insulator 10. As will be described in detail later, a plurality of ground electrodes 30 are provided.

As is well known, the ceramic insulator 10 is formed from, for example, alumina through firing. The ceramic insulator 10 is a tubular insulator and has an axial bore 12 which is provided at the center and extends therethrough in the axial direction OD. The ceramic insulator 10 has a collar portion 19 which is formed substantially at the center in the axial direction OD and has the greatest outside diameter, and a rear trunk portion 18 which is formed rearward (upward in FIG. 1) of the collar portion 19. The ceramic insulator 10 also has a forward trunk portion 17 which is formed forward (downward in FIG. 1) of the collar portion 19 and is smaller in outside diameter than the rear trunk portion 18. The ceramic insulator 10 further has a leg portion 13 which is formed forward of the forward trunk portion 17 and is smaller in outside diameter than the forward trunk portion 17. The leg portion 13 reduces in outside diameter toward the forward end thereof. When the spark plug 100 is mounted to an engine head 200 of an internal combustion engine, the leg portion 13 is exposed to a combustion chamber of the internal combustion engine. A stepped portion 15 is formed between the leg portion 13 and the forward trunk portion 17.

The metallic shell 50 is a cylindrical metallic member adapted to fix the spark plug 100 to the engine head 200 of the internal combustion engine. The metallic shell 50 holds the ceramic insulator 10 therein, and surrounds a part of the rear trunk portion 18 and a portion of the ceramic insulator 10 extending from the rear trunk portion 18 to the leg portion 13. The metallic shell 50 is formed of low-carbon steel and has a tool engagement portion 51, to which an unillustrated spark plug wrench is fitted, and a mounting threaded portion 52, which has a thread formed thereon and is threadingly engaged with a mounting threaded hole 201 of the engine head 200 provided at an upper portion of the internal combustion engine.

The metallic shell 50 has a collar-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral edge portion 205 around the opening of the mounting threaded hole 201. The deformation of the gasket 5 provides a seal between the spark plug 100 and the engine head 200, thereby preventing gas leakage from inside the engine through the mounting threaded hole 201.

The metallic shell 50 has a thin-walled crimped portion 53 located rearward of the tool engagement portion 51. The metallic shell 50 also has a buckled portion 58, which is thin-walled similar to the crimped portion 53, between the seal portion 54 and the tool engagement portion 51. Annular ring members 6 and 7 are interposed between the outer circumferential surface of the rear trunk portion 18 of the ceramic insulator 10 and the inner circumferential surface of the metallic shell 50 extending from the tool engagement portion 51 to the crimped portion 53; furthermore, a space between the two ring members 6 and 7 is filled with a powder of talc 9. When the precursor of the crimped portion 53 is bent inward and is thereby crimped, the ceramic insulator 10 is pressed forward within the metallic shell 50 via the ring members 6 and 7 and the talc 9. Accordingly, the stepped portion 15 of the ceramic insulator 10 is supported via the annular sheet packing 8 by a stepped portion 56 formed on the inner circumference of the metallic shell 50 at a position corresponding to the mounting threaded portion 52, whereby the metallic shell 50 and the insulator 10 are united together. At this time, gastightness between the metallic shell 50 and the ceramic insulator 10 is maintained by means of the annular sheet packing 8, thereby preventing outflow of combustion gas. The precursor of the buckled portion 58 is designed to be deformed outwardly as a result of application of compressive force in a crimping process, thereby contributing toward increasing the length of compression of the talc 9 in the axial direction OD and thus enhancing gastightness within the metallic shell 50. A clearance having a predetermined size is provided between the metallic shell 50 and the insulator 10 in a region located forward of the stepped portion 56.

The center electrode 20 is a rodlike electrode which has a structure in which a core 25 is embedded in an electrode base metal 21. The electrode base metal 21 is formed of nickel or a nickel alloy which contains nickel as a main component, such as INCONEL (trade name) 600 or 601. The core 25 is formed of copper or a copper alloy which contains copper as a main component, copper and the copper alloy being superior to the electrode base metal 21 in thermal conductivity. Usually, the center electrode 20 is manufactured as follows: the core 25 is fitted into the electrode base metal 21 formed into a closed-bottomed tubular shape; then, the resultant assembly is subjected to extrusion from the bottom side for prolongation. The core 25 has a substantially fixed outside diameter at its trunk portion and has a diameter reduced portion at its forward end. The center electrode 20 extends rearward within the axial bore 12 and is electrically connected to the metal terminal 40 located on the rear side (the upper side in FIG. 1) via a seal member 4 and a ceramic resistor 3 (FIG. 1). A high-voltage cable (not shown) is connected via a plug cap (not shown) to the metal terminal 40 so as to apply high voltage to the metal terminal 40.

The entire configuration of the spark plug 100 shown in FIG. 1 is a mere example. The spark plug can employ various other configurations.

FIG. 2(A) is a front view of a spark plug of a first embodiment showing, on an enlarged scale, discharge gaps and the vicinity thereof, FIG. 2(B) is a left side view thereof, and FIG. 2(C) is a bottom view thereof. FIG. 2(D) is an explanatory view obtained by removing a main ground electrode 300 from FIG. 2(C). The spark plug has, as electrodes, the center electrode 20, the main ground electrode 300 facing the center electrode 20, and three auxiliary ground electrodes 310, 320, 330. These electrodes 20, 300, 310, 320, 330 project downward from the ceramic insulator (insulator) 10. Although the main ground electrode 300 has a convex portion 302 formed on the upper surface of a distal end portion thereof, this convex portion 302 may be omitted. Notably, the center electrode 20 and the ground electrodes 300, 310, 320, 330 may be formed of the same material (e.g., a nickel alloy) or may be formed of different materials. The convex portion 302 may be formed of a material which is the same as the material used for forming these electrodes or may be formed of a material different from the material used for forming these electrodes. Also, a noble metal tip may be provided on each of the lower end of the center electrode 20 and the upper end of the convex portion 302 of the main ground electrode 300. Notably, in the above-described FIG. 1, in order to simplify the drawing, only one ground electrode 30 (corresponding to the main ground electrode 300) is illustrated as a representative of the four ground electrodes 300, 310, 320, 330.

The center electrode 20 is an approximately circular columnar electrode extending in the vertical direction (the axial direction OD in FIG. 1), and preferably its lower end has an approximately circular shape. The main ground electrode 300 is joined to the lower end of the metallic shell 50, and is bent by about 90 degrees to have an arcuate shape such that its distal end portion becomes approximately horizontal. A discharge gap G1 (spark gap) is formed between the convex portion 302 of the main ground electrode 300 and the center electrode 20 (FIG. 2(A)). Each of the three auxiliary ground electrodes 310, 320, 330 is also bent by about 90 degrees to have an arcuate shape such that its distal end portion becomes approximately horizontal. However, since the overall axial projection lengths of the auxiliary ground electrodes 310, 320, 330 are small, distal end portions of the auxiliary ground electrodes 310, 320, 330 face the side surface of the center electrode 20 (FIG. 2(A), FIG. 2(B)). In other words, the distal end portions of the auxiliary ground electrodes 310, 320, 330 are disposed such that they surround the circumference of the center electrode 20. In the present embodiment, the three auxiliary ground electrodes 310, 320, 330 have the same axial projection length. However, a portion of the auxiliary ground electrodes (e.g., the first auxiliary ground electrode 310) may have an axial projection length different from those of other auxiliary ground electrodes.

As shown in FIGS. 2(C) and 2(D), when viewed from the bottom side (i.e., on a plane orthogonal to the axial direction OD in FIG. 1), the three auxiliary ground electrodes 310, 320, 330 and the main ground electrode 300 have the following configurational features.

(A1) The three auxiliary ground electrodes 310, 320, 330 and the main ground electrode 300 are provided at equal angular intervals (i.e., intervals of 90 degrees) around the center electrode 20.

(A2) The first auxiliary ground electrode 310 is located at a position opposite the main ground electrode 300, with respect to the center electrode 20.

(A3) The second and third auxiliary ground electrodes 320, 330 are located opposite to each other with respect to the center electrode 20.

(A4) A direction which connects the center of the first auxiliary ground electrode 310 and the center of the center electrode 20 and a direction which connects the centers of the second and third auxiliary ground electrodes 320, 330 perpendicularly intersect with each other.

(A5) The distal end surface of the first auxiliary ground electrode 310 is flat.

(A6) Each of the distal end surfaces of the second and third auxiliary ground electrodes 320, 330 has an approximately cylindrical shape (has an approximately arcuate cross section).

(A7) A space PS having an approximately circular cross section (which will be referred to as the "hollow space PS") is formed between the distal end surfaces of the second and third auxiliary ground electrodes 320, 330. Notably, these configurational features are examples of preferred configurational features, and a portion of these configurational features may be omitted or modified in accordance with the application, etc. of the spark plug. For example, the distal end surface of the first auxiliary ground electrode 310 may have an approximately cylindrical shape (an approximately arcuate cross section). Also, the hollow space PS may have any cross-sectional shape other than an approximately circular shape.

Parameters described in FIGS. 2(A) to 2(D) are defined as follows.

<Definition of Parameters>

D: the diameter of the hollow space PS between the second and third auxiliary ground electrodes 320, 330

G1: the gap between the main ground electrode 300 and the center electrode 20 (also referred to as a "main discharge gap")

G2: the gap between the second auxiliary ground electrode 320 and the center electrode 20 (also referred to as an "auxiliary discharge gap")

G3: the gap between the third auxiliary ground electrode 330 and the center electrode 20 (also referred to as an "auxiliary discharge gap")

L: the width of the main ground electrode 300

S2: the distance between a side surface of a distal end portion of the second auxiliary ground electrode 320 and the distal end of the first auxiliary ground electrode 310, as measured along a direction from the center of the center electrode 20 toward the first auxiliary ground electrode 310 (also referred to as an "auxiliary electrode offset S2")

S3: the distance between a side surface of a distal end portion of the third auxiliary ground electrode 330 and the distal end of the first auxiliary ground electrode 310, as measured along the direction from the center of the center electrode 20 toward the first auxiliary ground electrode 310 (also referred to as an "auxiliary electrode offset S3")

T: the shortest distance between the second and third auxiliary ground electrodes 320, 330

Tp: the Y-direction component of the shortest distance T between the second and third auxiliary ground electrodes 320, 330 (which will be described later)

V2: the width of the second auxiliary ground electrode 320

V3: the width of the third auxiliary ground electrode 330

W: the width of the first auxiliary ground electrode 310

Figure 4:
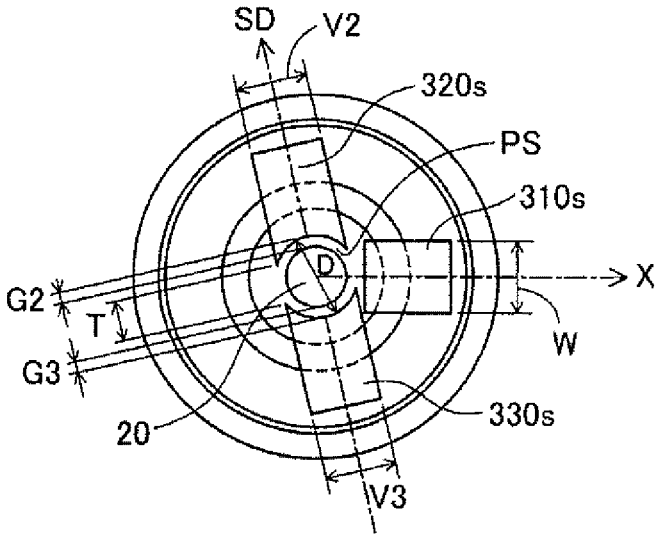
FIG. 4 illustrates a pair of explanatory views showing, on an enlarged scale, discharge gaps of a spark plug of a second embodiment and the vicinity thereof.
Figure 4:
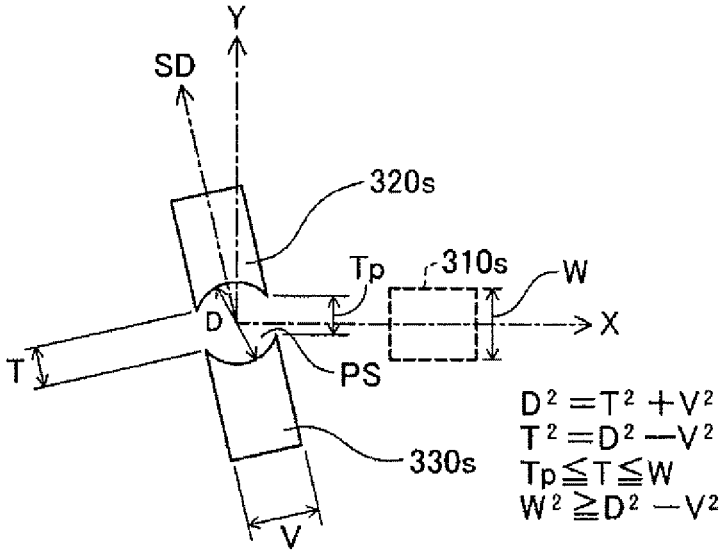

Notably, the X-direction is a direction which connects the center electrode 20 and the first auxiliary ground electrode 310, and the Y-direction is a direction orthogonal to the X-direction. Of the above-described various parameters, the gap G1 is a parameter in the height direction in the front view shown in FIG. 2(A). However, other parameters are those in the bottom view shown in FIG. 2(C) or FIG. 2(D) (parameters obtained by projecting relevant portions onto a plane perpendicular to the axial direction OD in FIG. 1). As will be described later with reference to FIG. 4, the Y-direction component Tp of the distance T is a parameter used in consideration of the case where the first direction in which the distal end portion of the first auxiliary ground electrode 310 extends and the second direction in which the distal end portions of the second and third auxiliary ground electrodes 320, 330 extends do not perpendicularly intersect with each other. In the first embodiment, since these two directions perpendicularly intersect with each other, T=Tp. Notably, when the distances S2, S3 are equal to each other, a parameter "distance S" is used so as to collectively represent the two distances. Also, when the widths V2, V3 are equal to each other, a parameter "width V" is used so as to collectively represent the two widths.

In the spark plug of the first embodiment shown in FIGS. 2(A) to 2(D), the following relations exist among the above-mentioned parameters.

(B1) The second and third auxiliary ground electrodes 320, 330 have the same shape and the values of corresponding two parameters (e.g., G2 and G3, S2 and S3, V2 and V3) are equal to each other.

(B2) The width W of the first auxiliary ground electrode 310 is equal to the widths V2, V3 of the second and third auxiliary ground electrodes 320, 330. Preferably, the widths W, V2, V3 of the auxiliary ground electrodes 310, 320, 330 fall within a range of, for example, about 2 mm to about 3 mm.

(B3) The widths W, V2, V3 of the auxiliary ground electrodes 310, 320, 330 are smaller than the width L of the main ground electrode 300. Preferably, the width L of the main ground electrode 300 falls within a range of, for example, about 3 mm to about 4 mm.

(B4) The shortest distance T between the second and third auxiliary ground electrodes 320, 330 is equal to its Y-direction component Tp.

(B5) The width W of the first auxiliary ground electrode 310 is equal to or greater than the Y-direction component Tp of the shortest distance T between the second and third auxiliary ground electrodes 320, 330. Preferably, the shortest distance T and its Y-direction component Tp fall within a range of about 2 mm to about 4 mm.

(B6) The distances S2, S3 (auxiliary electrode offsets) between the side surfaces of the distal end portions of the second and third auxiliary ground electrodes 320, 330 and the distal end of the first auxiliary ground electrode 310 are greater than zero but not greater than 0.7 mm.

(B7) Relations $|G2-G1|\leq 0.2$ mm and $|G3-G1|\leq 0.2$ mm exist between the gap G1 between the main ground electrode 300 and the center electrode 20, and the gaps G2, G3 between the second and third auxiliary ground electrodes 320, 330 and the center electrode 20.

(B8) The gap G1 of the main ground electrode 300 satisfy a relation $0.2\text{ mm}\leq G1\leq 1.0$ mm.

(B9) A relation $Tp\leq W\leq L$ exists among the width L of the main ground electrode 300, the width W of the first auxiliary ground electrode 310, and the Y-direction component Tp of the shortest distance T between the second and third auxiliary ground electrodes 320, 330.

Notably, these parametric relations are examples of preferred relations, and a portion of the parametric relations may be omitted or modified in accordance with the application, etc. of the spark plug.

The shapes, arrangements, and parametric relations of the electrodes in the spark plug of the first embodiment achieve the following effects.

First effect: since a plurality of auxiliary ground electrodes 310, 320, 330 are provided around the center electrode 20 at circumferential positions different from that of the main ground electrode 300, it is possible to reduce or restrain the phenomenon of multiple discharge which occurs due to a flow of gas (gas flow) around the center electrode 20. As is well known, in a normal discharge phenomenon of the spark plug, capacitive discharge first occurs, whereby discharge is started, and subsequently, inductive discharge occurs continuously. In the period of capacitive discharge, a spiky voltage change is observed. In the period of inductive discharge, the discharge between the center electrode 20 and the ground electrode 300 is maintained by a voltage much smaller than a voltage required to maintain that discharge in the period of capacitive discharge. Meanwhile, multiple discharge is a phenomenon in which a large number of spiky capacitive discharges occur in a period during which an ordinary inductive discharge occurs. Since multiple discharge produces a large number of spiky voltage changes, there arises a problem in that the electrodes are eroded or consumed due to the large number of spiky voltage changes. The present inventors found that if the space around the center electrode 20 is disturbed by a flow of gas, multiple discharge becomes more likely to occur and that the phenomenon of multiple discharge can be reduced effectively through provision of a plurality of auxiliary ground electrodes around the center electrode 20. In particular, by providing the first auxiliary ground electrode 310 on the side opposite the main ground electrode 300 with respect to the center electrode 20, occurrence of multiple discharge due to a flow of gas in this direction (−X direction) can be reduced or restrained, as compared with the case where the first auxiliary ground electrode 310 is not provided. Notably, the effect of blocking the flow of gas toward the vicinity of the discharge gap to thereby reduce multiple discharge is also referred to as a "gas flow blocking effect."

Second effect: since the width W of the first auxiliary ground electrode 310 is set to be greater than the distance Tp (FIG. 2(D)), the gas flow blocking effect achieved by the first auxiliary ground electrode 310 can be secured sufficiently (the above-mentioned parametric relation B5). Namely, multiple discharge can be reduced or prevented by enhancing the gas flow blocking effect achieved by the first auxiliary ground electrode 310, as compared with the case where the width W of the first auxiliary ground electrode 310 is smaller than the distance Tp.

Third effect: Since each of the auxiliary electrode offsets S2, S3 is set to a small value which is greater than zero but not greater than 0.7 mm, the effect of blocking a gas flow between the first and second auxiliary ground electrodes 310, 320 and the effect of blocking a gas flow between the first and third auxiliary ground electrodes 310, 330 can be enhanced sufficiently (the above-mentioned parametric relation B6). As a result, multiple discharge can be further reduced or prevented. Notably, the parametric relation B6 can be considered to mean that the distal end of the first auxiliary ground electrode 310 is more remote from the center electrode 20 than the side surfaces of the distal end portions of the second and third auxiliary ground electrodes 320, 330. Also, the auxiliary electrode offset S2 can be considered to be an index which indicates the size of the clearance between the first auxiliary ground electrode 310 and the second auxiliary ground electrode 320 measured in a direction (Y direction) orthogonal to the corresponding side surface of the main ground electrode 300 (i.e., the size of the gas flow channel). This also applies to the auxiliary electrode offset S3. Accordingly, in order to block a gas flow along this clearance, preferably, each of the auxiliary electrodes offsets S2, S3 is set to a small value not greater than 0.7 mm. Although each of the auxiliary electrodes offsets S2, S3 may be set to a value greater than 0.7 mm, the gas flow can be effectively blocked by setting each of the auxiliary electrodes offsets S2, S3 to 0.7 mm or less.

Fourth effect: Since the relevant parameters are set such that relations $|G2-G1| \leq 0.2$ mm and $|G3-G1| \leq 0.2$ mm are satisfied, not only the gap G1 of the main ground electrode 300 but also the gaps G2, G3 of the auxiliary ground electrodes 320, 330 can be used as discharge gaps (the above-mentioned parametric relation B7). Namely, the spark plug can generate discharge not only at the gap G1 of the main ground electrode 300 but also at the gaps G2, G3 of the auxiliary ground electrodes 320, 330. As a result, the voltage required for discharge (required voltage) can be lowered. Notably, typically, the gap G1 of the main ground electrode 300 is set to be smaller than the gaps G2, G3 of the auxiliary ground electrodes 320, 330. Specifically, it is preferred that the gap G1 of the main ground electrode 300 be set to a value which satisfies a relation $0.2 \text{ mm} \leq G1 \leq 1.0$ mm. The present inventors found that, of spark plugs for various applications, a spark plug for a gas engine which uses natural gas (LNG) or propane gas as a combustible gas is more likely to have a problem of generation of multiple discharge due to flows of gas, as compared with a spark plug for an engine in which gasoline or alcohol is burned. In the case of a spark plug for a gas engine, the gap G1 of the main ground electrode 300 is preferably set to a value which satisfies a relation $0.2 \text{ mm} \leq G1 \leq 1.0$ mm. In this case, through provision of the plurality of auxiliary ground electrodes 310, 320, 330, multiple discharge can be reduced effectively. Notably, each of the distal end surfaces of the second and third auxiliary ground electrodes 320, 330 is preferably formed to have an approximately cylindrical surface (an approximately arcuate cross section). In this case, the gaps G2, G3 between the center electrode 20 and the distal end surfaces of the second and third auxiliary ground electrodes 320, 330 can be more efficiently used as discharge gaps as compared with the case where the distal end surfaces of the second and third auxiliary ground electrodes 320, 330 are flat. Also, when the distal end surfaces of the second and third auxiliary ground electrodes 320, 330 are formed to have approximately cylindrical surfaces, the gas flow blocking effects at these gaps G2, G3 can be enhanced. Meanwhile, the distal end surface of the first auxiliary ground electrode 310 may be approximately flat as shown in FIG. 2(D), or may be formed to have an approximately cylindrical surface (an approximately arcuate cross section), as in the case of the second and third auxiliary ground electrodes 320, 330.

Fifth effect: Since the distance Tp and the width L of the main ground electrode 300 satisfy a relation $Tp \leq L$, the gap which is present between the second and third auxiliary ground electrodes 320, 330 and whose width is equal to Tp can be blocked by the main ground electrode 300 having the width L (the above-mentioned parametric relation B9). As a result, it is possible to enhance the gas flow blocking effect at a position around the center electrode 20, which position is located on the side toward the main ground electrode 300, whereby multiple discharge can be reduced or restrained. Notably, for the same reason, it is preferred that the width W of the first auxiliary ground electrode 310 satisfy the relation $Tp \leq W$. However, when the width W of the first auxiliary ground electrode 310 is increased excessively, the flow of a combustible gas toward the circumference of the center electrode 20 is prevented excessively, whereby the ignition performance of the spark plug may deteriorate. In view of this, it is preferred that the width W of the first auxiliary ground electrode 310 be smaller than the width L of the main ground electrode 300. Accordingly, satisfaction of a relation $Tp \leq W \leq L$ is preferred.

Figure 2:
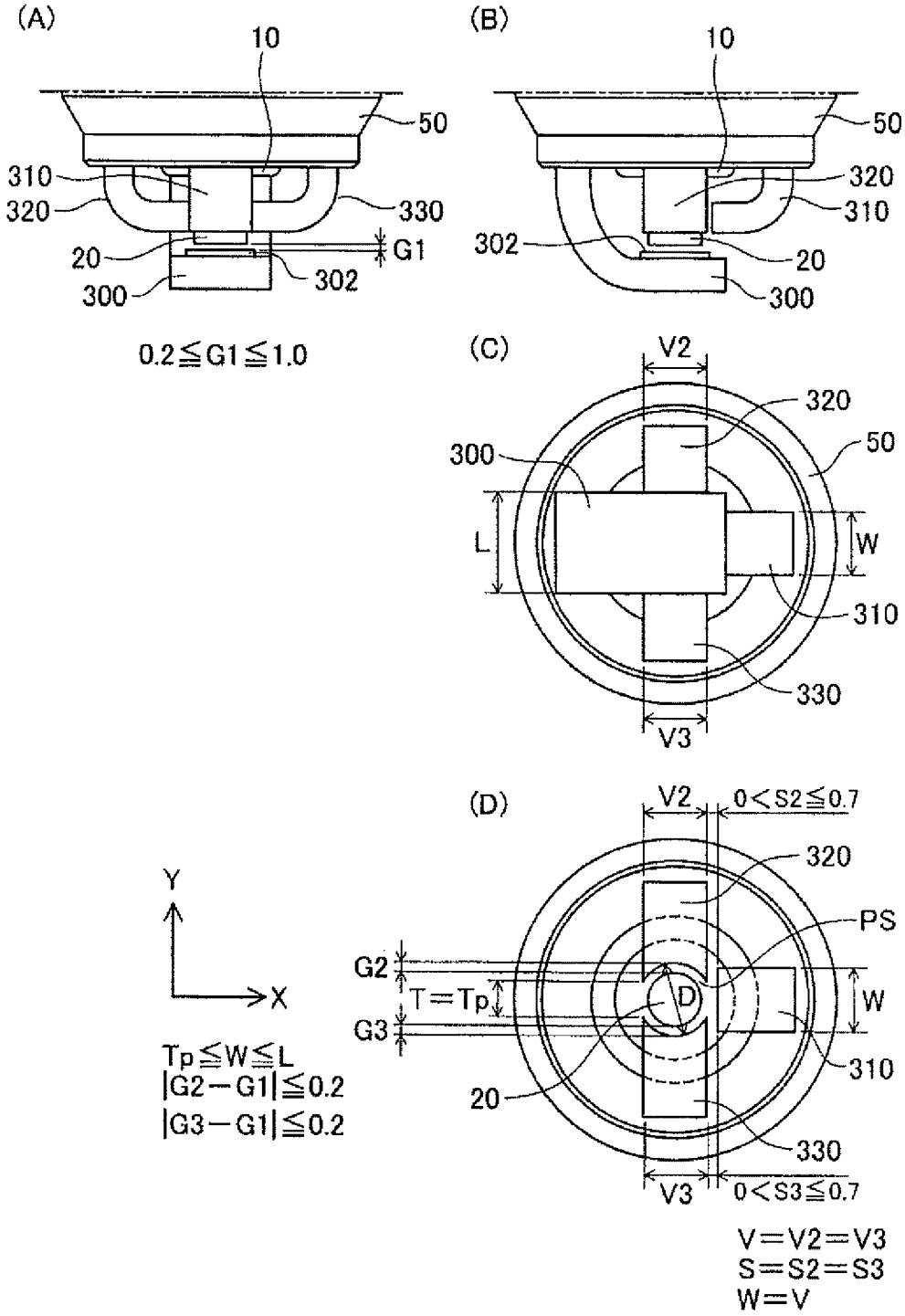
FIG. 2 illustrates a set of explanatory views showing, on an enlarged scale, discharge gaps of a spark plug of a first embodiment and the vicinity thereof.

As described above, in the case of the spark plug of the first embodiment shown in FIG. 2, in addition to the main ground electrode 300, the three auxiliary ground electrodes 310, 320, 330 are provided such that these four ground electrodes 300, 310, 320, 330 shield the circumference of the center electrode 20. Therefore, the gas flow blocking effect can be attained to a sufficient degree. As a result, it is possible to reduce or restrain multiple discharge which occurs due to presence of an excessive flow of gas around the center electrode 20. Notably, as can be understood from other embodiments which will be described below, the above-mentioned various shapes and parametric relations may be changed or modified in various manners.

Figure 3:
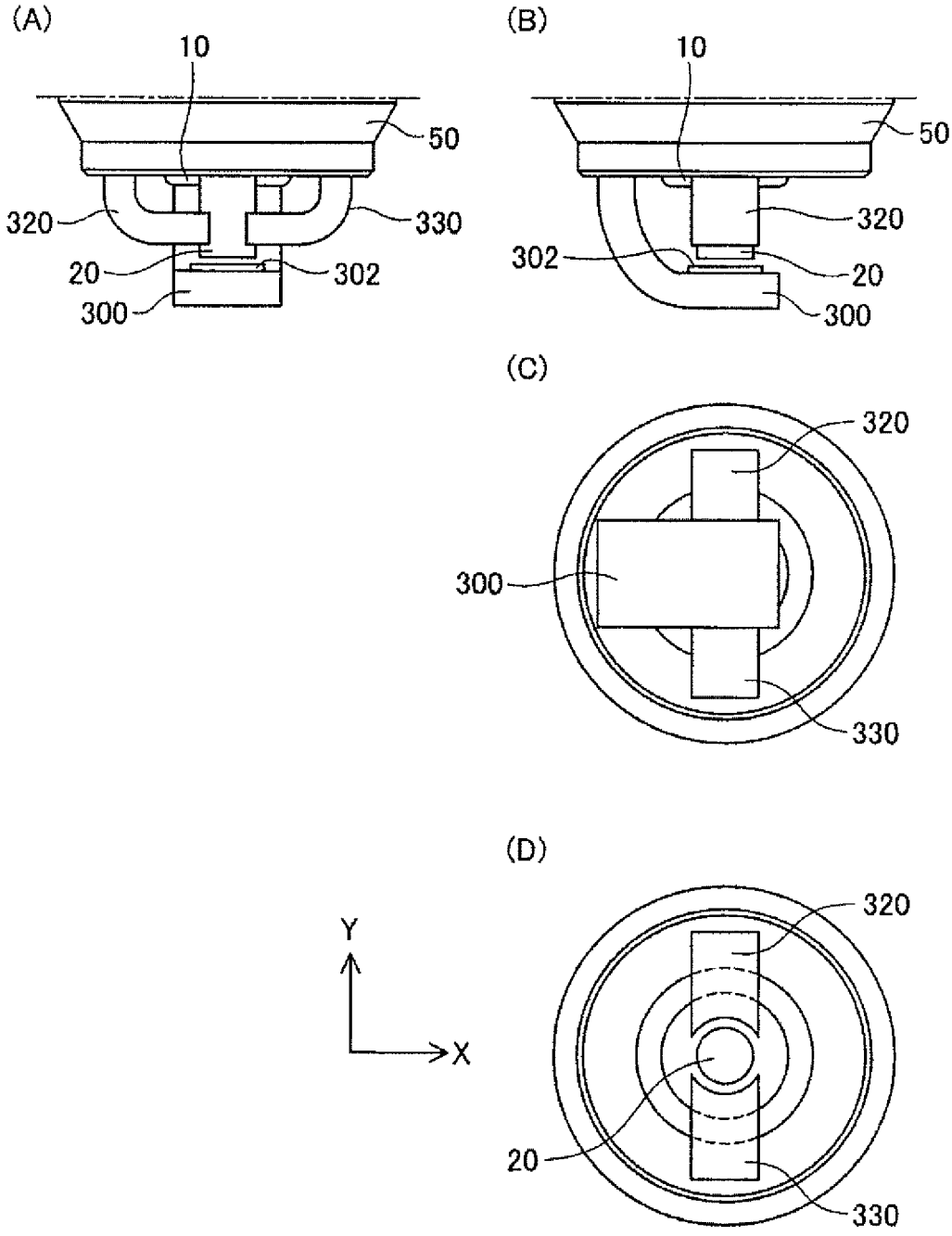
FIG. 3 illustrates a set of explanatory views showing, on an enlarged scale, discharge gaps of a spark plug which serves as a comparative example and the vicinity thereof.

FIG. 3 is a set of explanatory views showing, on an enlarged scale, discharge gaps of a spark plug which serves as a comparative example and the vicinity thereof. This comparative example differs from the first embodiment shown in FIG. 2 in the point that the first auxiliary ground electrode is not provided. In this comparative example, the gas flow blocking effect by the first auxiliary ground electrode cannot be attained. Therefore, multiple discharge tends to occur more frequently as compared with the first embodiment.

FIG. 4(A) is an explanatory view of a second embodiment, and corresponds to FIG. 2(D) of the first embodiment. In this spark plug, a direction SD in which the distal end portions of second and third auxiliary ground electrodes 320*s*, 330*s* extend does not perpendicularly intersect with the direction X in which the distal end portion of a first auxiliary ground electrode 310*s* extends. Notably, in FIG. 4(A), the main ground electrode 300 is not shown. As in the case of the first embodiment, the main ground electrode 300 can be provided at a position opposite the first auxiliary ground electrode 310*s*.

In FIG. 4(B), the second and third auxiliary ground electrodes 320*s*, 330*s* of FIG. 4(A) are depicted by continuous lines, and the first auxiliary ground electrode 310*s* is depicted by a broken line with its position shifted. The shortest distance T between the second and third auxiliary ground electrodes 320*s*, 330*s* is the distance measured along the SD direction in which the distal end portions of these electrodes extend. The Y-direction is a direction orthogonal to the X-direction (a direction in which the distal end portion of the first auxiliary ground electrode 310*s* extends). In the case where the Y-direction and the SD-direction differ from each other, the Y-direction component Tp of the shortest distance T is smaller than the shortest distance T. As can be understood from FIG. 4(A), this component Tp shows the size of an opening of the hollow space PS between the second and third auxiliary ground electrodes 320*s*, 330*s*, which opening is open toward the first auxiliary ground electrode 310*s* (the size of a gas flow channel).

In FIG. 4(B), the width V (=V2=V3) of the second and third auxiliary ground electrodes 320*s*, 330*s*, the diameter D of the hollow space PS between the electrodes 320*s*, 330*s*, and the shortest distance T between the electrodes 320*s*, 330*s* satisfy the following relations.

$$D^2=T^2+V^2 \quad (1)$$

$$T^2=D^2-V^2 \quad (2)$$

As described above, the Y-direction component Tp of the shortest distance T shows the size of the opening of the hollow space PS between the second and third auxiliary ground electrodes 320*s*, 330*s*, which opening is open toward the direction (X-direction) in which the first auxiliary ground electrode 310*s* extends. Accordingly, in order to sufficiently secure the gas flow blocking effect by the first auxiliary ground electrode 310*s*, it is preferred that the width W of the first auxiliary ground electrode 310*s* be equal to or greater than the distance Tp and the distance T (the above-mentioned parametric relation B9).

$$Tp \leq T \leq W \quad (3)$$

In consideration of the above-described expressions (2) and (3), the width W of the first auxiliary ground electrode 310*s*, the diameter D of the hollow space PS between the second and third auxiliary ground electrodes 320*s*, 330*s*, and the width V of the second and third auxiliary ground electrodes 320*s*, 330*s* satisfy the following relation.

$$W^2 \geq D^2-V^2 \quad (4)$$

If this expression (4) is satisfied, the X-direction opening of the hollow space PS can be blocked sufficiently by the first auxiliary ground electrode 310*s*, whereby multiple discharge can be reduced or restrained.

Figure 5:
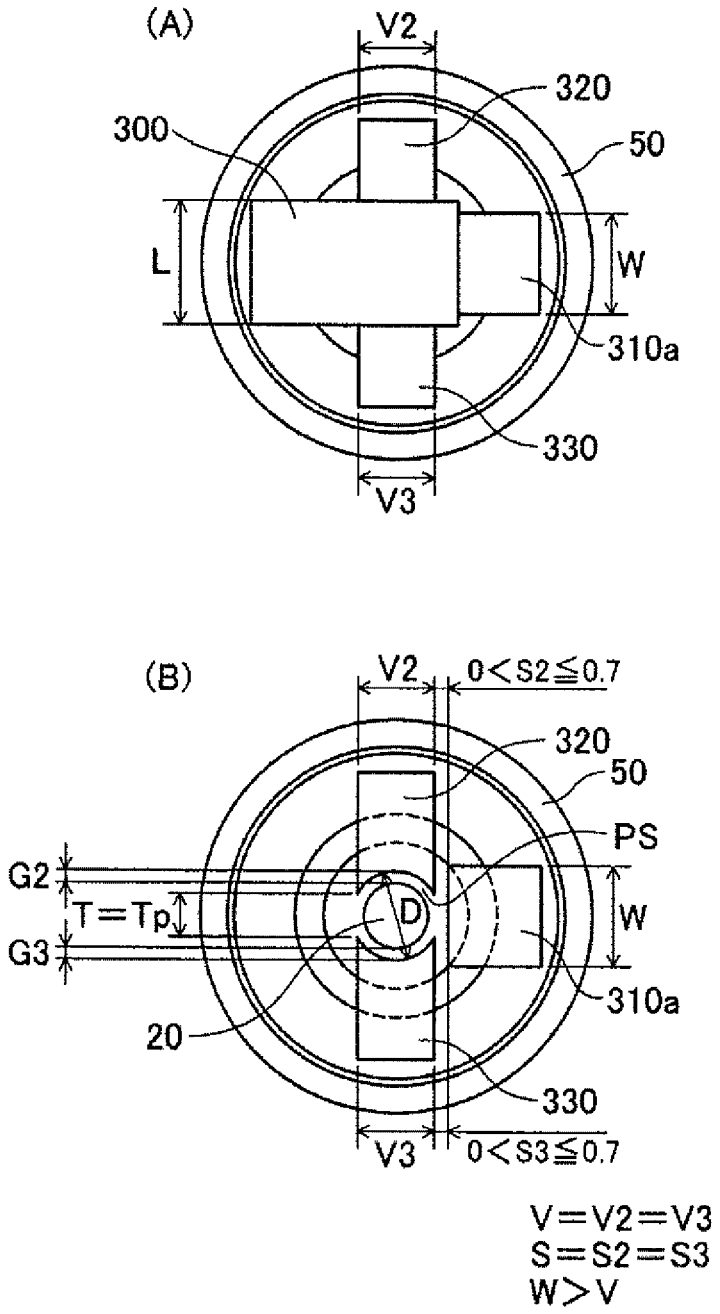
FIG. 5 illustrates a pair of explanatory views showing, on an enlarged scale, discharge gaps of a spark plug of a third embodiment and the vicinity thereof.

FIGS. 5(A) and 5(B) are explanatory views showing, on an enlarged scale, discharge gaps of a spark plug of a third embodiment and the vicinity thereof, and correspond to FIGS. 2(C) and 2(D). This third embodiment has the same configuration as the first embodiment, except that the width W of the first auxiliary ground electrode 310*a* is greater than the width V of the second and third auxiliary ground electrodes 320, 330. Since this configuration can further enhance the gas flow blocking effect by the first auxiliary ground electrode 310*a*, multiple discharge can be reduced or restrained further. Notably, in contrast to the third embodiment, the width of the first auxiliary ground electrode 310 may be made slightly smaller than the width V of the second and third auxiliary ground electrodes 320, 330.

Figure 6:
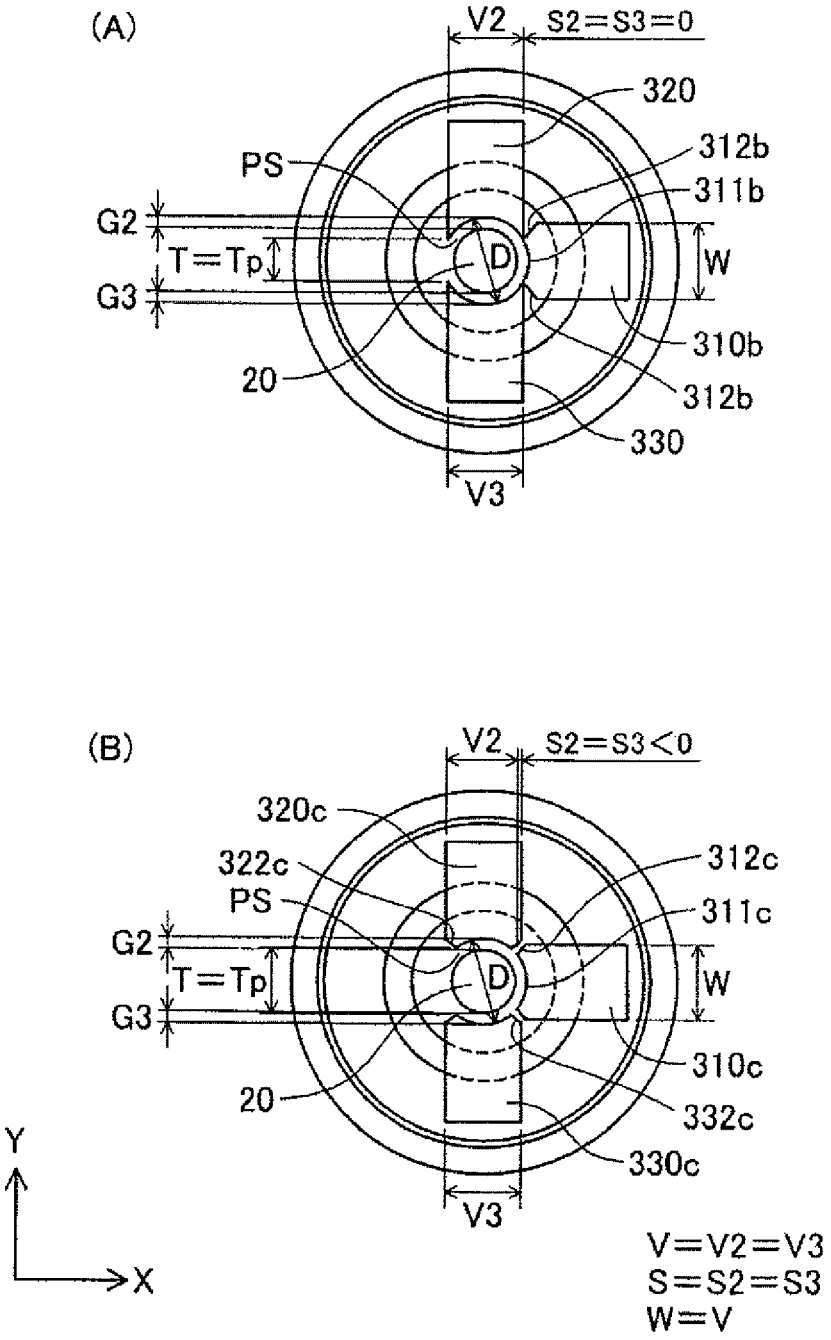
FIG. 6 illustrates a pair of explanatory views showing, on an enlarged scale, discharge gaps of spark plugs of fourth and fifth embodiments and the vicinity thereof.

FIG. 6(A) is an explanatory view showing, on an enlarged scale, discharge gaps of a spark plug of a fourth embodiment and the vicinity thereof, and corresponds to FIG. 2(D) of the first embodiment. The fourth embodiment has the same configuration as the first embodiment, except the shape and position of the distal end portion of a first auxiliary ground electrode 310*b*. Namely, the distal end portion of this first auxiliary ground electrode 310*b* has a distal end surface 311*b* having an approximately arcuate cross section, and has taper portions 312*b* on the opposite side thereof. The distal end surface 311*b* has a shape which matches a circle having a diameter D, which is formed by the hollow space PS between the second and third auxiliary ground electrodes 320, 330. Accordingly, the gaps between the center electrode 20 and the three auxiliary ground electrodes 310*b*, 320, 330 are substantially the same in size. As a result, more stable discharge can be generated by using these gaps, and the voltage required for discharge can be lowered. The taper portions 312*b* of the first auxiliary ground electrode 310*b* prevent interference between the first auxiliary ground electrode 310*b* and the second and third auxiliary ground electrodes 320, 330. Notably, in this fourth embodiment, the auxiliary electrode offsets S2, S3 are 0 mm. Also, the clearance between the first auxiliary ground electrode 310*b* and the second auxiliary ground electrode 320 and the clearance between the first auxiliary ground electrode 310*b* and the third auxiliary ground electrode 330 are approximately 0. Since this configuration can further enhance the gas flow blocking effect by the first auxiliary ground electrode 310*b*, multiple discharge can be reduced or restrained further.

FIG. 6(B) is an explanatory view showing, on an enlarged scale, discharge gaps of a spark plug of a fifth embodiment and the vicinity thereof. The fifth embodiment has the same configuration as the fourth embodiment, except the shapes and positions of the distal end portions of first through third auxiliary ground electrodes 310*c*, 320*c*, 330*c*. Namely, each of the distal end portions of the first through third auxiliary ground electrodes 310*c*, 320*c*, 330*c* has a distal end surface having an approximately arcuate cross section, and has taper portions 312*c*, 322*c*, 332*c* on the opposite side thereof. Further, the auxiliary electrode offsets S2, S3 are minus. Notably, the auxiliary electrode offsets S2, S3 are values measured, along the X-direction (the direction in which the first auxiliary ground electrode 310*c* extends), from those (the right side surfaces in FIG. 6(B)) among opposite side surfaces of the distal end portions of the second and third auxiliary ground electrodes 320*c*, 330*c* which are closer to the first auxiliary ground electrode 310*c*. Namely, in the fifth embodiment, the distal end of the first auxiliary ground electrode 310*c* is closer to the center electrode 20 than the corresponding side surfaces of the distal end portions of the second and third auxiliary ground electrodes 320*c*, 330*c*. This arrangement is achieved by formation of the taper portions 312*c*, 322*c*, 332*c* on the opposite sides of the distal end portions of the first through third auxiliary ground electrode 310*c*, 320*c*, 330*c*. The fifth embodiment is more preferable than the fourth embodiment, because a sufficiently large clearance can be secured between adjacent two of the three auxiliary ground electrodes 310*c*, 320*c*, 330*c* so as to prevent interference among them.

FIGS. 7(A) to 7(D) are explanatory views showing, on an enlarged scale, discharge gaps of a spark plug of a sixth embodiment and the vicinity thereof, and correspond to FIGS. 2(A) to 2(D) of the first embodiment. The sixth embodiment has the same configuration as the first embodiment, except that the distal ends of three auxiliary ground electrodes 310*d*, 320*d*, 330*d* are located at positions which are more remote from the center electrode 20, and the distal end surface of the first auxiliary ground electrode 310*d* has an approximately cylindrical shape (that is, an approximately arcuate cross section which matches the circle having the diameter D). Since the distal ends of the three auxiliary ground electrodes 310*d*, 320*d*, 330*d* are located at positions which are more remote from the center electrode 20, the auxiliary electrode offsets S2, S3 are greater than 0.7 mm. Namely, in this configuration, since the distal ends of the three auxiliary ground electrodes 310*d*, 320*d*, 330*d* are located at positions which are more remote from the center electrode 20, the gas flow blocking effects by these electrodes 310*d*, 320*d*, 330*d* are weaker than those in the first embodiment. Accordingly, from the viewpoint of reducing or restricting multiple discharge, the first embodiment in which the auxiliary electrode offsets S2, S3 are smaller is more preferable than this sixth embodiment.

Figure 7:
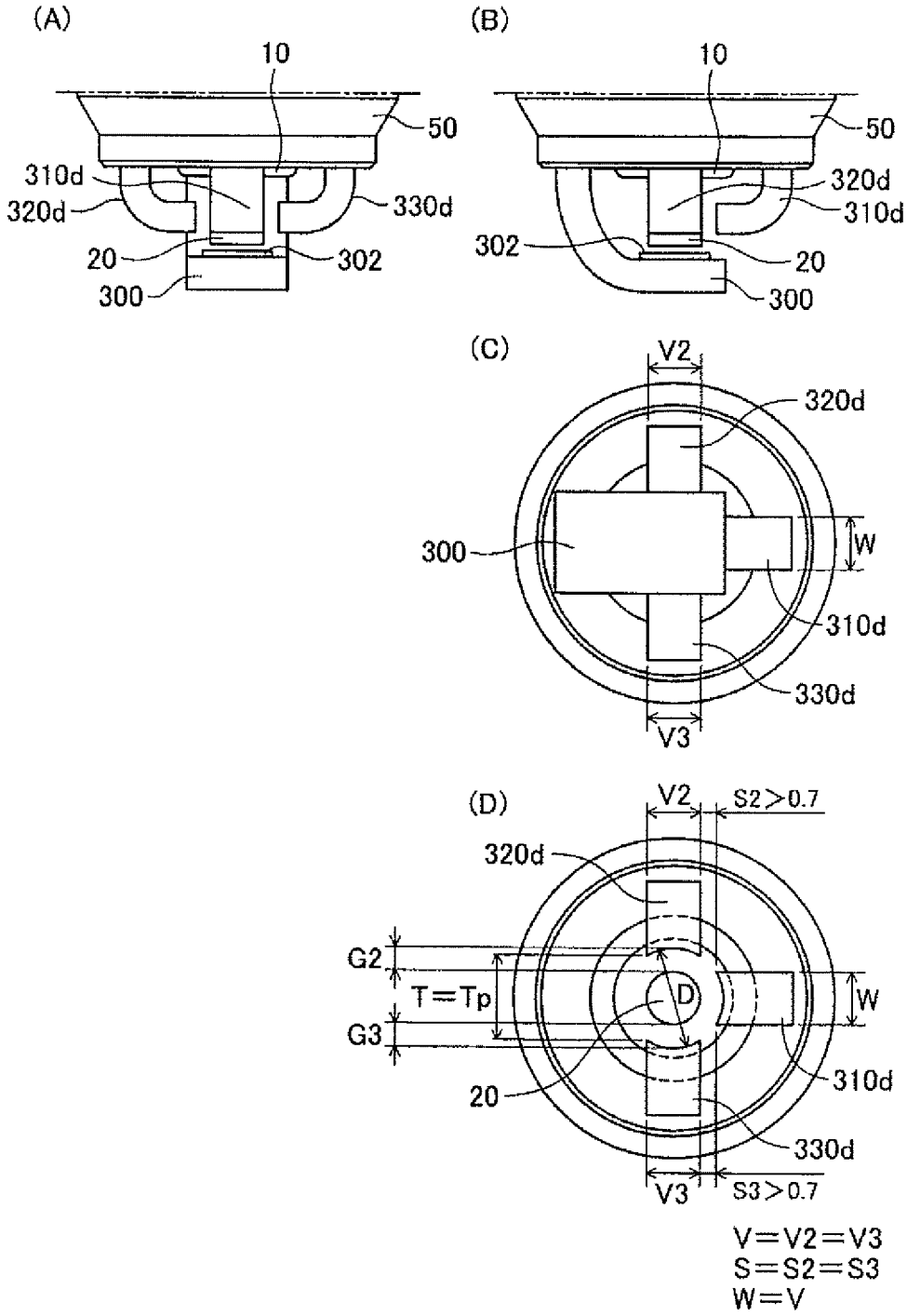
FIG. 7 illustrates a set of explanatory views showing, on an enlarged scale, discharge gaps of a spark plug of a sixth embodiment and the vicinity thereof.
Figure 8:
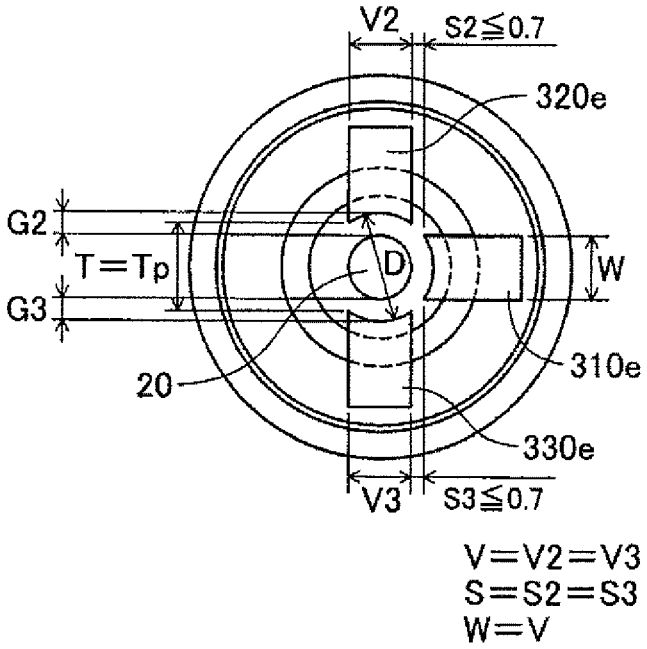
FIG. 8 is an explanatory view showing, on an enlarged scale, discharge gaps of a spark plug of a seventh embodiment and the vicinity thereof.

FIG. 8 is an explanatory view showing, on an enlarged scale, discharge gaps of a spark plug of a seventh embodiment and the vicinity thereof, and corresponds to FIG. 7(D) of the sixth embodiment. The seventh embodiment has the same configuration as the sixth embodiment, except that the distal ends of three auxiliary ground electrodes 310*e*, 320*e*, 330*e* are located at positions which are closer to the center electrode 20. Since the distal end of the first auxiliary ground electrode 310*e* is located at a position which is closer to the center electrode 20, the auxiliary electrode offsets S2, S3 are equal to or less than 0.7 mm. This configuration is preferable because the gas flow blocking effects by the auxiliary ground electrodes 310*e*, 320*e*, 330*e* are stronger than those in the sixth embodiment. Also, in this seventh embodiment, each of the distal end surfaces of the three auxiliary ground electrodes 310*e*, 320*e*, 330*e* has a shape (an approximately arcuate cross section) which matches the circle having the diameter D, and the gaps between the center electrode 20 and the three auxiliary ground electrodes 310*e*, 320*e*, 330*e* are the same in size. This preferable feature is common to the fourth embodiment shown in FIG. 6(A) and the fifth embodiment shown in FIG. 6(B). However, in the seventh embodiment, no taper portion is formed at the distal end portions of the auxiliary ground electrodes 310*e*, 320*e*, 330*e*. Therefore, manufacture is easier.

Figure 9:
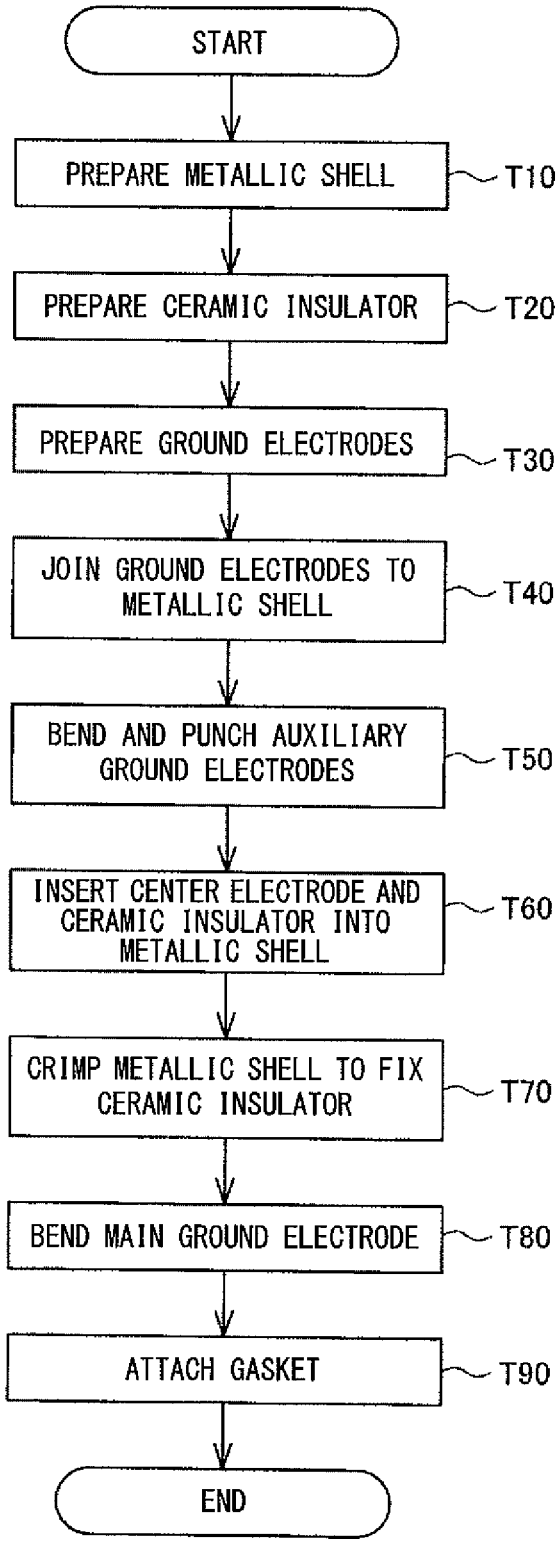
FIG. 9 is a flowchart showing steps of a method of producing a spark plug.

FIG. 9 is a flowchart showing steps of a method of producing the spark plug according to one embodiment of the present invention. In step T10, the metallic shell 50 is prepared, and in step T20, the ceramic insulator 10 is prepared. In step T30, the main ground electrode 300 and the auxiliary ground electrodes 310, 320, 330 are prepared. In step T40, the main ground electrode 300 and the auxiliary ground electrodes 310, 320, 330 are joined to the metallic shell 50, and in step T50, bending and punching are performed for the auxiliary ground electrodes 310, 320, 330.

Figure 10:
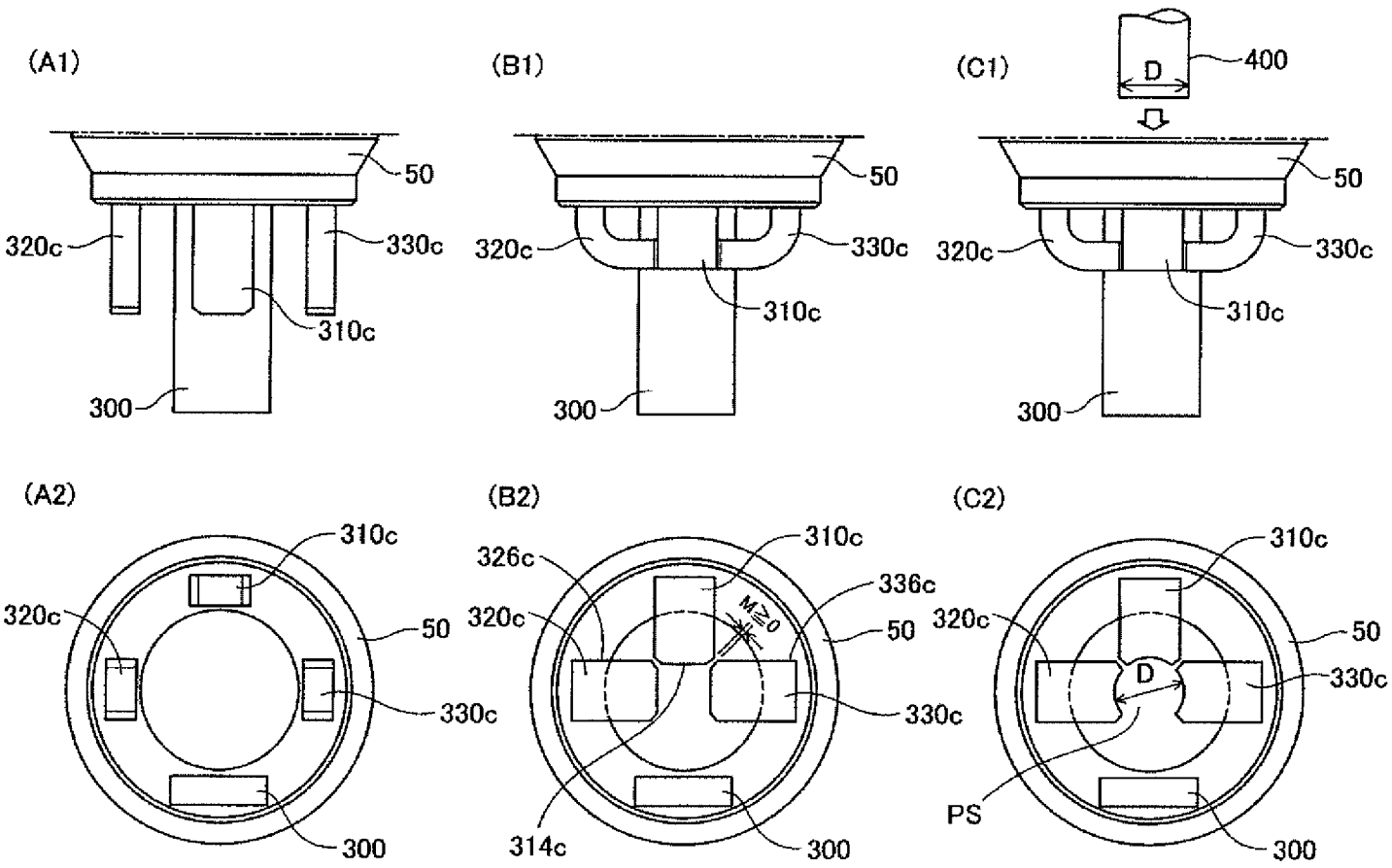
FIG. 10 illustrates a set of explanatory views showing bending and punching in step T50 of FIG. 9.

FIG. 10 is an explanatory view showing the bending and punching performed in step T50. FIG. 10(A1) to 10(C2) show the process of machining the spark plug of the fifth embodiment having been described with reference to FIG. 6(B). FIGS. 10(A1) to 10(C1) are front views of the lower end of the spark plug, and FIGS. 10(A2) to 10(C2) are bottom views thereof. In FIG. 10, the convex portion 302 (FIG. 2(A) is not provided on the distal end portion of the main ground electrode 300. However, the convex portion 302 may be provided on the distal end portion of the main ground electrode 300 in any step performed after or before step T50 shown in FIG. 10. FIGS. 10(A1) and 10(A2) show a state after the main ground electrode 300*c* and the auxiliary ground electrodes 310*c*, 320*c*, 330*c* have been joined to the metallic shell 50 in step T40. In this example, rod-like electrode members are prepared and joined to the metallic shell 50. After that, the distal ends of the three auxiliary ground electrodes 310*c*, 320*c*, 330*c* are bent, by about 90 degrees, into an arcuate shape through use of a first bending tool (not shown).

FIGS. 10(B1) and 10(B2) show a state after bending. Although the distal ends of electrode members which are to become the auxiliary ground electrodes 310*c*, 320*c*, 330*c* are punched in a punching step to be described later, FIGS. 10(B1) and 10(B2) show the shapes of the electrode members before being punched. The length of each electrode member before being subjected to bending is determined in advance such that, after the bending, the shortest distance M between adjacent auxiliary ground electrodes (e.g., electrodes 310*c*, 320*c*) becomes equal to or greater than 0. Notably, this shortest distance M corresponds to the distance between the distal ends of the adjacent auxiliary ground electrodes. It is preferred that this shortest distance M be 0 or greater, because the distal ends of the auxiliary ground electrodes do not interfere with one another at the time of bending. Although the shortest distance M may be set to 0, in consideration of machining errors, it is preferred that this shortest distance M be set to a value greater than 0, more preferably, set to 0.2 mm or greater, and most preferably, set to 0.4 mm or greater.

Notably, it is preferred that, after simultaneous bending of the first through third auxiliary ground electrodes 310*c*, 320*c*, 330*c*, the distal end 314*c* of the first auxiliary ground electrode 310*c* on the side toward the second and third auxiliary ground electrodes 320*c*, 330*c* is located on the center electrode 20 side in relation to the side surfaces 326*c*, 336*c* of the second and third auxiliary ground electrodes 320*c*, 330*c* on the side toward the first auxiliary ground electrode 310*c*, as shown in FIGS. 10(B1) and 10(B2). In this configuration, since the distal ends of the first through third auxiliary ground electrodes 310*c*, 320*c*, 330*c* can be made closer to one another, the hollow space PS which is subsequently formed by punching these distal ends can be made smaller. As a result, the flow of gas into the hollow space PS can be blocked effectively, whereby multiple discharge can be reduced.

FIGS. 10(C1) and 10(C2) show a step in which the distal end portions of the auxiliary ground electrodes 310*c*, 320*c*, 330*c* are punched through use of a punching tool 400. This punching tool 400 has an approximately circular cross section having a diameter D. As a result of the distal end portions of the three auxiliary ground electrodes 310*c*, 320*c*, 330*c* being punched by the punching tool 400, a generally circular hollow space PS having a diameter D is formed. Since the distal end portions of the plurality of auxiliary ground electrodes 310*c*, 320*c*, 330*c* located at the center are punched after the bending, the generally circular hollow space PS can be precisely formed by a single step. Since the center electrode 20 (see FIG. 6(B)) is disposed at the center of the hollow space PS, gaps of substantially the same size can be formed between the auxiliary ground electrodes 310*c*, 320*c*, 330*c* and the center electrode 20.

Notably, the bending and punching shown in FIG. 10 can be applied to any embodiment other than the embodiment shown in FIG. 6(B). However, in the embodiments shown in FIGS. 2, 4, and 5, the shape of the punching tool 400 is determined such that the distal end of the first auxiliary ground electrode 310 is not punched. Also, in the case where each of the distal ends of the auxiliary ground electrodes has a cross sectional shape other than the arcuate shape (e.g., the taper portions 312*b*) as in the embodiments shown in FIGS. 6(A) and 6(B), that cross sectional shape may be formed by the punching tool. Alternatively, the cross sectional shape other than the arcuate shape, such as the taper portions 312*b*, may be previously formed at the distal ends of the electrode members before being subjected to the bending. Alternatively, the entire shape of the distal end of each auxiliary ground electrode may be previously formed at the distal ends of the electrode members before being subjected to the bending.

After completion of the bending and punching of the auxiliary ground electrodes, an assembly process of inserting the center electrode 20 and the ceramic insulator 10 into the metallic shell 50 is performed in step T60 of FIG. 9. Upon completion of this assembly process, there is obtained an assembly in which the ceramic insulator (insulator) 10 and the center electrode 20 are assembled into the metallic shell 50. There are two methods for assembling them; i.e., (i) a method in which the ceramic insulator 10 into which the center electrode 20 has been assembled is assembled into the metallic shell 50; and (ii) a method in which the ceramic insulator 10 is assembled into the metallic shell 50, and then the center electrode 20 is assembled into the ceramic insulator 10. Either of these methods may be employed. In step T70, the metallic shell 50 is crimped by using a crimping tool (not shown). As a result of the crimping, the ceramic insulator 10 is fixed to the metallic shell 50. After that, in step T80, the distal end of the main ground electrode 300 is bent through use of a second bending tool (not shown), and in step T90, the gasket 5 is attached to the mounting threaded portion 52 of the metallic shell 50, whereby the spark plug 100 is completed.

Notably, the production method shown in FIG. 9 is a mere example, and the spark plug can be manufactured by any of various methods other than the production method shown in FIG. 9. For example, the sequence of steps T10 to T90 may be changed to some degree.

EXAMPLES

An experiment for determining discharge performance as described below was performed for a plurality of samples corresponding to some of the above-described embodiments.

Figure 11:
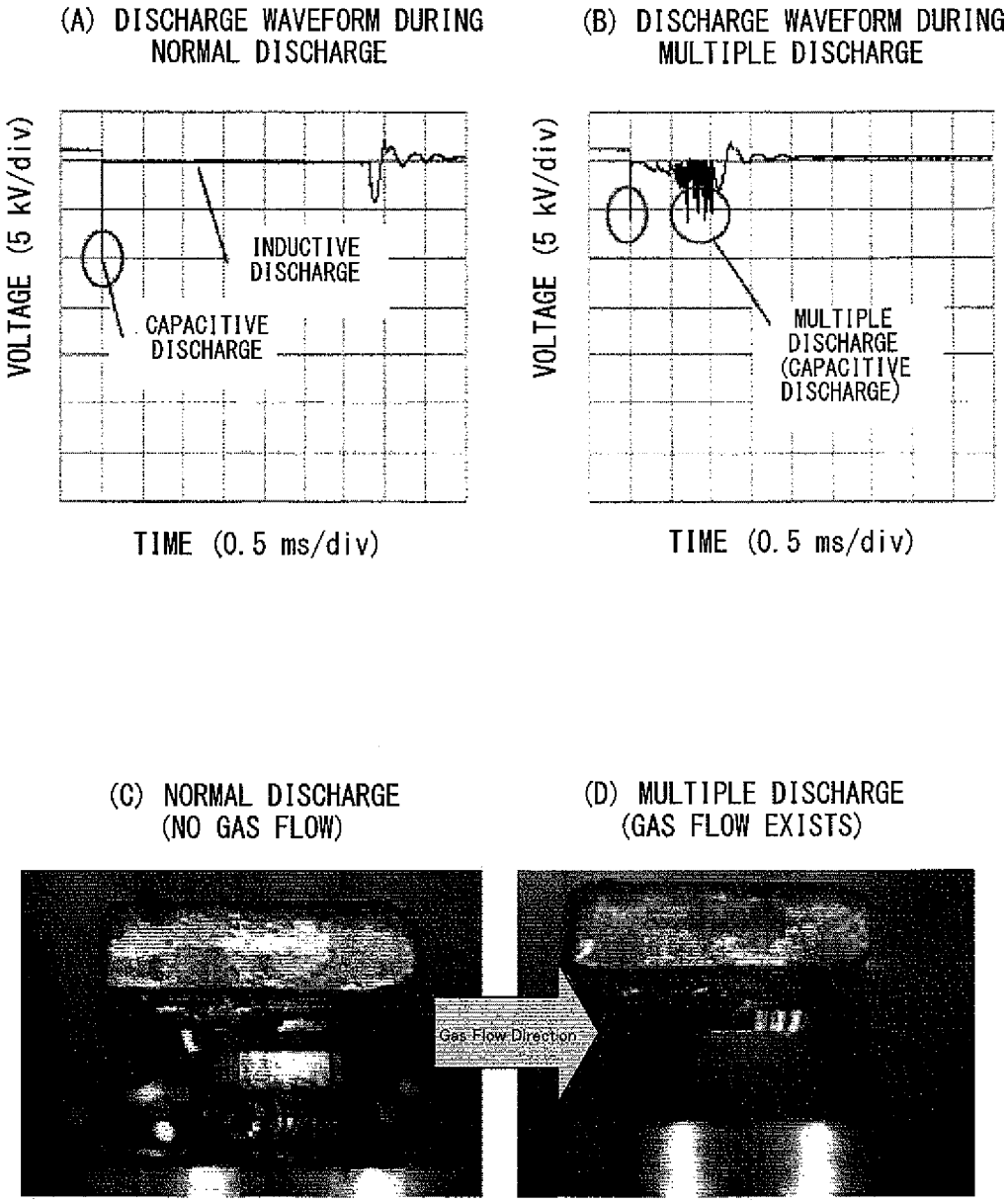
FIG. 11 illustrates a set of explanatory views showing a discharge waveform observed when normal discharge occurs and a discharge waveform observed when multiple discharge occurs.

FIG. 11(A) shows a discharge waveform observed when normal discharge occurs, and FIG. 11(B) shows a discharge waveform observed when multiple discharge occurs. As shown in FIG. 11(A), at the time of normal discharge, inductive discharge continues for a while after capacitive discharge, and then the inductive discharge ends. As is well known, capacitive discharge is a short-time discharge phenomenon in which a large voltage is applied in the form of a pulse, and inductive discharge is a long-time discharge phenomenon in which a voltage lower than that in the case of capacitive discharge continues. FIG. 11(B) shows a state in which multiple discharge has occurred. Multiple discharge is a phenomenon in which a large number of pulse-shaped voltage changes occur in a period during which inductive discharge continues if normal discharge occurs. If such multiple discharge occurs, consumption of the electrodes of the spark plug is accelerated. As shown in FIGS. 11(C) and 11(D), even in the case of a spark plug which generates discharge normally in a state in which no gas flow is prevent, multiple discharge becomes more likely to occur if a gas flow is present.

FIG. 12(A) shows an example of the results (multiple discharge occurrence ratio) of an experiment performed for an example and a comparative example. The example is a spark plug having a shape identical to that of the fifth embodiment shown in FIG. 6(B). The comparative example is a spark plug in which the second and third auxiliary ground electrodes 320, 330 are provided although the first auxiliary ground electrode 310 is not provided (FIG. 3). In the example and the comparative example, the width W (=V) of the auxiliary ground electrodes 310 to 330 was set to 2.7 mm, and the shortest distance T between the second and third auxiliary ground electrodes 320, 330 was set to 2.4 mm.

Figure 12:
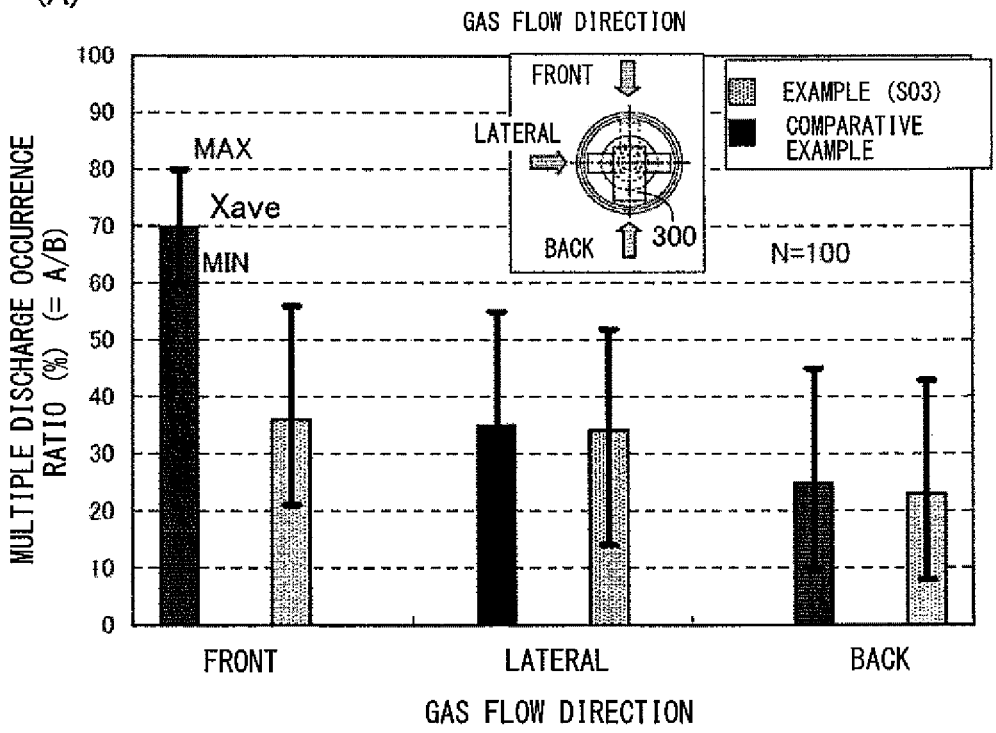
FIG. 12 illustrates a set of graphs showing an example of the results (multiple discharge occurrence ratio) of an experiment performed for an example and a comparative example.
Figure 12:
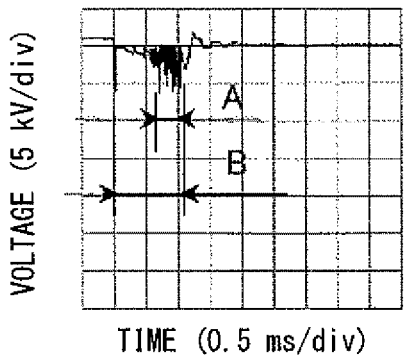

FIG. 12(8) shows a method of measuring multiple discharge occurrence ratio. In FIG. 12(B), a period A represents a period during which multiple discharge occurs, and a period B represents a period of the entirety of discharge (also referred to as the "entire discharge period B"). The multiple discharge occurrence ratio is the ratio of the multiple discharge generation period A to the entire discharge period B (=A/B). The entire discharge period B is a period between a point in time when capacitive discharge occurs and a point in time when discharge ends. As can be understood from FIGS. 12(B), 11(A), and 11(B), when discharge ends, the voltage between the center electrode and the ground electrode drops temporarily and then increases. Accordingly, a point in time immediately before the temporary drop of the voltage can be determined as a "discharge end point." The multiple discharge generation period A is a portion of the entire discharge period B during which multiple discharge occurs. The start point of the multiple discharge generation period A can be determined from a point in time when the voltage between the center electrode and the ground electrode drops by a predetermined amount (e.g., 5 kV) or more. The end point of the multiple discharge generation period A can be determined from a point in time after which the drop of the voltage between the center electrode and the ground electrode does not exceed the predetermined amount (e.g., 5 kV).

FIG. 12(A) shows the multiple discharge occurrence ratios determined for three cases; i.e., the case where the gas flow direction is front, the case where the gas flow direction is lateral, and the case where the gas flow direction is back. "Front" means the direction of a flow of combustion gas from the front side of the main ground electrode 300 toward the main ground electrode 300 (−X direction in FIG. 2(D), and "back" means the opposite direction. Also, "lateral" means a direction which connects the second and third auxiliary ground electrodes 320, 330. Notably, a test for determining the multiple discharge occurrence ratio was performed 100 times, and the average of the obtained 100 values of the multiple discharge occurrence ratio was employed. In the case where the gas flow direction was front, Sample S03 had an average multiple discharge occurrence ratio of about 35%, and the comparative example had an average multiple discharge occurrence ratio of about 70%. In the case where the gas flow direction was lateral, each of Sample S03 and the comparative example had an average multiple discharge occurrence ratio of about 35%. In the case where the gas flow direction was back, Sample S03 had an average multiple discharge occurrence ratio of about 23%, and the comparative example had an average multiple discharge occurrence ratio of about 25%. From this experimental result, it can be understood that, in the case where the gas flow direction is front, the multiple discharge occurrence ratio of the example (Sample S03) is very low as compared with the comparative example. This means that the first auxiliary ground electrode 310 provided on the front side of the main ground electrode 300 exhibits a remarkable gas flow blocking effect. Meanwhile, in the case where the gas flow direction is lateral or back, the gas flow blocking effect achieved by the first auxiliary ground electrode 310 is not so strong.

FIG. 13 shows the shapes of five types of spark plug samples S01 to S05 and their experimental results (multiple discharge occurrence ratio Xave). Sample S01 has a shape identical to that of the first embodiment (FIG. 2) except for parameter S. In the case of Sample S01, the width W (=V) of the auxiliary ground electrodes 310, 320, 330 is 2.7 mm, the shortest distance T between the second and third auxiliary ground electrodes 320, 330 is 2.4 mm, the auxiliary electrode offset S is 0.8 mm, and parametric relations T≤W and 0.7 mm<S hold. Sample S02 has a shape substantially identical to that of Sample S01, and differs from Sample S01 only in the point that the auxiliary electrode offset S is 0.7 mm, and a parametric relation S≤0.7 mm holds. Sample S03 has a shape identical to that of the fifth embodiment (FIG. 6(B)). In the case of Sample S03, the width W (=V) of the auxiliary ground electrodes 310*c*, 320*c*, 330*c* is 2.7 mm, the shortest distance T between the second and third auxiliary ground electrodes 320*c*, 330*c* is 2.4 mm, the auxiliary electrode offset S is −0.1 mm, and parametric relations T≤W and S<0 hold. Notably, this Sample S03 is identical to the sample used as the example shown in FIG. 12(A). Sample S04 has a shape identical to that of the sixth embodiment (FIG. 7). In the case of Sample S04, the width W (=V) of the auxiliary ground electrodes 310*d*, 320*d*, 330*d* is 2.2 mm, the shortest distance T between the second and third auxiliary ground electrodes 320*d*, 330*d* is 3.5 mm, the auxiliary electrode offset S is 0.8 m, and parametric relations W<T and 0.7 mm<S hold. Sample S05 has a shape identical to that of the seventh embodiment (FIG. 8). In the case of Sample S05, the width W (=V) of the auxiliary ground electrodes 310*e*, 320*e*, 330*e* is 2.2 mm, the shortest distance T between the second and third auxiliary ground electrodes 320*e*, 330*e* is 3.5 mm, the auxiliary electrode offset S is 0.7 mm, and parametric relations W<T and S≤0.7 mm hold.

The multiple discharge occurrence ratio Xave shown in a lower section of FIG. 13 shows the ratio of the period during which multiple discharge occurs to the entire discharge period. The values of the multiple discharge occurrence ratio Xave are also average values each obtained by performing a test 100 times. In the case where the gas flow direction is front, the multiple discharge occurrence ratios of Samples S01, S02, S03 are about 35%, and the multiple discharge occurrence ratios of Samples S04, S05 are about 50%. Presumably, this difference occurs because of the following reason. In the case of Samples S01, S02, S03, since the width W of the first auxiliary ground electrode 310 is 2.7 mm and is sufficiently larger than the shortest distance T between the second and third auxiliary ground electrodes 320, 330 (=2.4 min), the gas flow blocking effect achieved by the first auxiliary ground electrode 310 is strong. Meanwhile, it is presumed that, in the case of Samples S04, S05, since the width W of the first auxiliary ground electrode 310 is 2.2 mm and is much smaller than the shortest distance T between the second and third auxiliary ground electrodes 320, 330 (=3.5 mm), the gas flow blocking effect achieved by the first auxiliary ground electrode 310 is weak, and the multiple discharge occurrence ratio increases slightly. Accordingly, it is preferred that the parameters T and W satisfy a relation T≤W.

In the case where the gas flow direction is lateral, since the multiple discharge occurrence ratios of Samples S01, S02, S03 gradually decrease in this order, Sample S03 is most preferred among these samples. The main difference among these three Samples S01, S02, S03 is the value of the auxiliary electrode offset S. Namely, it is preferred that the auxiliary electrode offset S have a value not greater than 0.7 mm rather than a value greater than 0.7 mm. Also, the value of S preferably satisfies a relation 0≤S≤0.7 mm, most preferably, a relation S<0 (S is negative). This is because the auxiliary electrode offset S is an index which represents the size of a flow channel which is located between the first auxiliary ground electrode 310 and the second auxiliary ground electrode 320 (or the third auxiliary ground electrode 330) and which is open in a direction orthogonal to the side surface of the first auxiliary ground electrode 310. Namely, as can be understood from FIG. 2 and FIGS. 6(A) and 6(B), the smaller the auxiliary electrode offset S, the smaller the width of the flow channel which is open in the direction orthogonal to the side surface of the first auxiliary ground electrode 310 (the Y-direction in FIG. 2). Accordingly, it is preferred that the auxiliary electrode offset S be small, because the effect of blocking a gas flow in the lateral direction is strong and multiple discharge can be reduced. This is also confirmed from the experimental results of Samples S04, S05.

FIG. 14 shows results of a test performed for determining the influence of the sizes of the auxiliary discharge gaps on the durability of spark plugs. Here, the "sizes of the auxiliary discharge gaps" mean the discharge gaps G2, G3 between the center electrode 20 and the second and third auxiliary ground electrodes 320, 330. In the test, a spark plug in which no auxiliary ground electrode is provided and only one ground electrode (only the main ground electrode 300) is provided was used as a reference example. In the spark plug of the reference example, the initial gap G between the center electrode 20 and the ground electrode 300 was set to 0.3 mm. Notably, the "initial gap" refers to the discharge gap before performance of an endurance test. Two samples; i.e., Samples S10, S03, which have a shape identical to the shape of the fifth embodiment (FIG. 6(B)) were used as examples. Sample S03 at the right end of FIG. 14 has the same dimensions as those of Sample S03 shown in FIG. 13. In the case of Sample S03, the main discharge gap G1 is set to 0.3 mm, and the auxiliary discharge gaps G2, G3 are set to 0.3 mm. This Sample S03 satisfies a relation |G2−G1|≤0.2 mm. Sample S10 at the center of FIG. 14 is identical in size to Sample S03 except that the auxiliary discharge gaps G2, G3 is changed to 0.6 mm. This Sample S10 satisfies a relation |G2−G1|>0.2 mm.

The vertical axis of FIG. 14 shows the voltage required to start discharge (required voltage). Notably, the width of the required voltage indicates the range of results obtained by testing about 10 samples. The higher the required voltage, the greater the difficulty of discharge. Therefore, it is preferred that the required voltage be low. The required voltages of the reference example and Samples S10, S03 (examples) measured before performance of the endurance test varied within a range of 11 to 16 kV, and there was almost no difference among the reference example and the examples. Meanwhile, when the required voltage was again measured after performance of an endurance test for 2,000 hours, the required voltage of the reference example increased greatly to a range of 23 to 35 kV. In contrast, the required voltage of Sample S10 increased by a smaller amount; i.e., to a range of 22 to 29 kV, and the required voltage of Sample S03 increased by the smallest amount; i.e., to a range of 22 to 27 kV. As described above, it can be understood that the spark plugs of the examples are also preferred from the viewpoint of the small increase of the required voltage after use of the spark plug for a long period of time. Also, as can be understood from the comparison between Sample S10 and Sample S03, it is preferred that the absolute values of the differences between the auxiliary discharge gaps G2, G3 and the main discharge gap G1 satisfy relations |G2−G1|≤0.2 mm and |G3−G1|≤0.2 mm. This is because it is presumed that the smaller the differences between the auxiliary discharge gaps G2, G3 and the main discharge gap G1, the greater the possibility that discharge occurs at both the auxiliary discharge gaps G2, G3 and the main discharge gap. In other words, the greater the differences between the auxiliary discharge gaps G2, G3 and the main discharge gap G1, the greater the possibility that discharge occurs only at the main discharge gap. In view of this, it is preferred that the auxiliary discharge gaps G2, G3 have the same size as that of the main discharge gap G1 (G1=G2=G3). Notably, it is preferred that the value of the discharge gap G1 satisfy a relation 0.2 mm≤G1≤1 mm. This is because, in the case where the main discharge gap G1 is a considerably small and satisfies this relation, through provision of the three auxiliary ground electrodes 310 to 330 in addition to the main ground electrode 300, the gas flow blocking effect is enhanced, whereby the effect of reducing multiple discharge becomes remarkable.

DESCRIPTION OF REFERENCE NUMERALS

3: ceramic resistor
4: seal member
5: gasket
6, 7: ring member
8: sheet packing
9: talc
10: ceramic insulator
12: axial bore
13: leg portion
15: stepped portion
17: forward trunk portion
18: rear trunk portion
19: collar portion
20: center electrode
21: electrode base metal
25: core
30: ground electrode
40: metal terminal
50: metallic shell
51: tool engagement portion
52: mounting threaded portion
53: crimped portion
54: seal portion
55: seat surface
56: stepped portion
58: buckled portion
59: screw neck
100: spark plug
200: engine head
201: mounting threaded hole
205: opening peripheral edge portion
300: main ground electrode
302: convex portion
310 to 330: auxiliary ground electrode
311*b*: distal end surface
312*b*, 312*c*, 322*c*, 332*c*: taper portion
314*c*: distal end
326*c*: side surface
400: punching tool

The invention claimed is:

1. A spark plug comprising:
a center electrode extending in an axial direction;
an insulator having an axial bore which extends in the axial direction and into which the center electrode is inserted;
a metallic shell disposed around the insulator;
a main ground electrode whose proximal end portion is joined to a forward end portion of the metallic shell and whose distal end portion forms a gap G1 in the axial direction in cooperation with a forward end portion of the center electrode; and
three auxiliary ground electrodes whose proximal end portions are joined to the forward end portion of the metallic shell and whose distal end portions form gaps in cooperation with a side surface of the center electrode, wherein
facing surfaces of the distal end portions of the three auxiliary ground electrodes which form the gaps in cooperation with the center electrode are located forward of the forward end of the insulator with respect to the axial direction;
a first auxiliary ground electrode of the three auxiliary ground electrodes is joined to the metallic shell at a position opposite a position at which the main ground electrode is joined to the metallic shell, with respect to the center electrode; and
second and third auxiliary ground electrodes of the three auxiliary ground electrodes are joined to the metallic shell at positions opposite to each other with respect to the center electrode,
wherein when a width of the first auxiliary ground electrode is represented by W, a shortest distance between the second auxiliary ground electrode and the third auxiliary ground electrode is represented by T, and a distance which is a component of the shortest distance T in a direction orthogonal to the first auxiliary ground electrode is represented by Tp, a relation W≥Tp is satisfied.

2. A spark plug according to claim 1, wherein distances S2, S3 between the distal end portion of the first auxiliary ground electrode located on the side toward the center electrode and side surfaces of the distal end portions of the second and third auxiliary ground electrodes satisfy relations S2≤0.7 mm and S3≤0.7 mm.

3. A spark plug according to claim 2, wherein the gap G1 and the gaps G2, G3 between the center electrode and the second and third auxiliary ground electrodes satisfy relations |G2−G1|≤0.2 mm and |G3−G1|≤0.2 mm.

4. A spark plug according to claim 3, wherein the gap G1 satisfies a relation 0.2 mm≤G1≤1.0 mm.

5. A spark plug according to claim 1, wherein a width L of the main ground electrode and the distance Tp satisfies a relation L≥Tp.

6. A spark plug according to claim 5, wherein a relation L≥W≥Tp is satisfied.

7. A spark plug according to claim 1, wherein the spark plug is used for a gas engine.

8. A method of producing a spark plug comprising:
a center electrode extending in an axial direction;
an insulator having an axial bore which extends in the axial direction and into which the center electrode is inserted;
a metallic shell disposed around the insulator;
a main ground electrode whose proximal end portion is joined to a forward end portion of the metallic shell and whose distal end portion forms a gap G1 in the axial direction in cooperation with a forward end portion of the center electrode; and
three auxiliary ground electrodes whose proximal end portions are joined to the forward end portion of the metallic shell and whose distal end portions form gaps in cooperation with a side surface of the center electrode, wherein
facing surfaces of the distal end portions of the three auxiliary ground electrodes which form the gaps in cooperation with the center electrode are located forward of the forward end of the insulator with respect to the axial direction;
a first auxiliary ground electrode of the three auxiliary ground electrodes is joined to the metallic shell at a position opposite a position at which the main ground electrode is joined to the metallic shell, with respect to the center electrode; and second and third auxiliary ground electrodes of the three auxiliary ground electrodes are joined to the metallic shell at positions opposite to each other with respect to the center electrode, wherein when a width of the first auxiliary ground electrode is represented by W, a shortest distance between the second auxiliary ground electrode and the third auxiliary ground electrode is represented by T, and a distance which is a component of the shortest distance T in a direction orthogonal to the first auxiliary ground electrode is represented by Tp, a relation $W \geq Tp$ is satisfied, said method comprising:

a step of joining the first through third auxiliary ground electrodes to the metallic shell;

a step of bending the first through third auxiliary ground electrodes after the joining step;

an assembly step of assembling, after the bending step, the insulator and the center electrode into the metallic shell so as to form an assembly; and a punching step of punching the distal end portions of the second and third auxiliary ground electrodes by using a punching tool having an approximately circular cross section such that a hollow space is formed at least at a central portion between the distal end portions of the second and third auxiliary ground electrodes, wherein when a width of each of the second and third auxiliary ground electrodes measured along a direction which is orthogonal to a direction connecting the second and third auxiliary ground electrodes and is also orthogonal to the axial direction is represented by V and a diameter of the hollow space formed between the second and third auxiliary ground electrodes is represented by D, a relation $W^2 \geq D^2 - V^2$ is satisfied.

9. A method of producing a spark plug according to claim 8, wherein lengths of the first through third auxiliary ground electrodes before being subjected to the bending are determined such that when the first through third auxiliary ground electrodes are bent simultaneously, a shortest distance M between a side surface of each of the second and third auxiliary ground electrodes on the side toward the first auxiliary ground electrode and the distal end of the first auxiliary ground electrode located on the side toward the second and third auxiliary ground electrodes satisfies a relation $M \geq 0$.

10. A method of producing a spark plug according to claim 9, wherein the first through third auxiliary ground electrodes before being subjected to the bending have taper portions provided on the distal end portions thereof; and when the first through third auxiliary ground electrodes are bent simultaneously, the distal end of the first auxiliary ground electrode located on the side toward the second and third auxiliary ground electrodes is located on the center electrode side in relation to the side surfaces of the second and third auxiliary ground electrodes on the side toward the first auxiliary ground electrode.

* * * * *